US010454233B2

(12) United States Patent
Miyakawa et al.

(10) Patent No.: US 10,454,233 B2
(45) Date of Patent: Oct. 22, 2019

(54) METHOD FOR MANUFACTURING TERMINAL WITH ELECTRIC WIRE

(71) Applicant: YAZAKI CORPORATION, Tokyo (JP)

(72) Inventors: Daisuke Miyakawa, Shizuoka (JP); Tomonori Kawakami, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 196 days.

(21) Appl. No.: 15/385,115

(22) Filed: Dec. 20, 2016

(65) Prior Publication Data

US 2017/0179663 A1 Jun. 22, 2017

(30) Foreign Application Priority Data

Dec. 22, 2015 (JP) ..... 2015-249461

(51) Int. Cl.

| | |
|---|---|
| ***H01R 43/05*** | (2006.01) |
| ***H01R 4/18*** | (2006.01) |
| ***H01R 13/52*** | (2006.01) |
| ***H01R 43/24*** | (2006.01) |
| *H01R 4/70* | (2006.01) |

(52) U.S. Cl.

CPC ..... *H01R 43/05* (2013.01); *H01R 4/185* (2013.01); *H01R 13/5216* (2013.01); *H01R 43/24* (2013.01); *H01R 4/70* (2013.01)

(58) Field of Classification Search

CPC ..... H01R 4/70; H01R 13/5216; H01R 43/05; H01R 43/24; H01R 4/185

See application file for complete search history.

(56) References Cited

U.S. PATENT DOCUMENTS

| | | | | |
|---|---|---|---|---|
| 6,334,798 | B1 * | 1/2002 | Ushijima | H01R 4/187 439/203 |
| 7,954,235 | B2 * | 6/2011 | Martauz | H01R 4/184 174/84 C |
| 2006/0075631 | A1 * | 4/2006 | Case | H05K 13/0812 29/709 |

(Continued)

FOREIGN PATENT DOCUMENTS

| | | | |
|---|---|---|---|
| CN | 103403967 | A | 11/2013 |
| JP | 3-39929 | A | 2/1991 |

(Continued)

OTHER PUBLICATIONS

Japanese Office Action for the related Japanese Patent Application No. 2015-249461 dated Feb. 6, 2018.

(Continued)

*Primary Examiner* — Minh N Trinh

(74) *Attorney, Agent, or Firm* — Kenealy Vaidya LLP

(57) ABSTRACT

A method for manufacturing a terminal with an electric wire includes: forming a conductor exposed portion by removing a resin coating of an electric wire; forming a wire-terminal connection portion by connecting a terminal fitting to a position of the conductor exposed portion; and supplying a sealing material from a nozzle to the wire-terminal connection portion. During supply of the sealing material, the nozzle is moved in X-, Y- and Z-directions or a relative position between the wire-terminal connection portion and the nozzle is changed in the X-, Y- and Z-directions.

5 Claims, 16 Drawing Sheets

(56) References Cited

U.S. PATENT DOCUMENTS

| | | | | |
|---|---|---|---|---|
| 2010/0092683 | A1* | 4/2010 | Ermantraut | G01N 35/1011 427/424 |
| 2013/0213709 | A1* | 8/2013 | Kawamura | H01R 4/183 174/72 A |
| 2013/0292173 | A1 | 11/2013 | Inoue et al. | |
| 2014/0295591 | A1 | 10/2014 | Nonogawa et al. | |
| 2015/0303151 | A1* | 10/2015 | Kobayashi | H01L 24/19 174/261 |
| 2017/0179663 | A1* | 6/2017 | Miyakawa | H01R 4/185 |

FOREIGN PATENT DOCUMENTS

| | | | |
|---|---|---|---|
| JP | 2008-177031 | A | 7/2008 |
| JP | 2010-175380 | A | 8/2010 |
| JP | 2011-113708 | A | 6/2011 |
| JP | 2012-174447 | A | 9/2012 |
| JP | 2014-116414 | A | 6/2014 |
| JP | 2014-130703 | A | 7/2014 |
| JP | 2014-192502 | A | 10/2014 |
| JP | 2015-153716 | A | 8/2015 |

OTHER PUBLICATIONS

Chinese Office Action for the related Chinese Patent Application No. 201611197635.0 dated Jul. 26, 2018.

Japanese Office Action for the related Japanese Patent Application No. 2015-249461 dated Aug. 7, 2018.

Chinese Office Action for the related Chinese Patent Application No. 201611197635.0 dated Jan. 22, 2019.

Japanese Office Action for the related Japanese Patent Application No. 2015-249461 dated Oct. 30, 2018.

Decision to Decline the Amendment for the related Japanese Patent Application No. 2015-249461 dated Oct. 30, 2018.

* cited by examiner

<SUPPLY TO COATING CRIMPING PART>

<SUPPLY TO NON-CRIMPING PART>

<SUPPLY TO NON-CRIMPING PART>

<SUPPLY TO CONDUCTOR CRIMPING PART>

METHOD FOR MANUFACTURING TERMINAL WITH ELECTRIC WIRE

CROSS-REFERENCE TO RELATED APPLICATION(S)

This application is based on and claims priority from Japanese Patent Application (Application No. 2015-249461) filed on Dec. 22, 2015, the entire contents of which are incorporated herein by reference.

BACKGROUND

1. Field of the Invention

The present invention relates to a method for manufacturing a terminal with an electric wire, in which an anticorrosion portion is formed in a connection part where different kinds of metals are connected to each other between the electric wire and a terminal fitting.

2. Description of Related Art

A wire harness is wired in a vehicle, for example, in order to establish electric connection between devices mounted on a car. The wire harness is configured to include an electric wire bundle, and various connectors disposed at terminal ends of the electric wire bundle. Each connector for the wire harness is configured to include an insulating connector housing, and a plurality of conductive terminal fittings received in terminal reception chambers of the connector housing. The terminal fittings are disposed at terminal ends of electric wires constituting the electric wire bundle. Copper electric wires (whose conductors consist of stranded wires made of copper or a copper alloy) are generally used as the electric wires. The terminal fittings are crimped and connected to terminal ends of the copper electric wires from which coatings have been removed. Incidentally, a base material of the terminal fittings is made of copper or a copper alloy in the same manner as the conductors of the copper electric wires. Plating may be applied to the terminal fittings.

In recent years, aluminum electric wires (electric wires whose conductors are made of aluminum or an aluminum alloy are referred to as aluminum electric wires herein) may be used in place of copper electric wires in consideration of weight reduction of a vehicle and easiness in recycling materials as well as shortage of copper resources. However, it has been known that an oxide film formed in the surface of an aluminum electric wire is thicker than that in the surface of a copper electric wire whose conductor is made of copper, and contact resistance between a conductor of the aluminum electric wire and a terminal fitting (crimping terminal) is apt to be comparatively higher. Therefore, in order to reduce the contact resistance between the conductor of the aluminum electric wire and the crimping terminal, the following method is used. That is, a pair of conductor crimping pieces are formed in the crimping terminal, and the conductor is strongly crimped by the conductor crimping pieces to increase a compression rate. According to this method, the conductor of the aluminum electric wire is strongly crimped so that an oxide film on each of strands constituting the conductor can be broken. That is, the contact resistance between the conductor and the crimping terminal can be reduced.

However, it has been known that when water intervenes in a contact part between an aluminum material and a copper material or, to say other words, in a contact part between different kinds of metals, both the metals, that is, aluminum and copper are dissolved into the water as ions so that electric corrosion can occur due to a potential difference or the like between the both. Incidentally, when a conductor of an aluminum electric wire and a crimping terminal made of copper or a copper alloy are electrically and mechanically connected to each other, the conductor is crimped with a high compression rate by conductor crimping pieces of the crimping terminal so that water immersion can be prevented in the crimping part where the conductor is crimped, with the result that occurrence of electric corrosion can be avoided. However, in a position in an axial direction of the terminal (in an extending direction of the electric wire) with respect to the crimping part where the conductor is crimped by the conductor crimping pieces, the conductor is exposed partially. Therefore, when water adhering to the exposed part of the conductor reaches the crimping part, the crimping part becomes a state as if it were immersed in an electrolytic solution. Thus, there is a fear that aluminum that is a metal having a higher ionization tendency may be dissolved to advance electric corrosion. As a solution, in order to prevent water from adhering to the exposed part of the conductor or from entering into the crimping part, an anticorrosion portion 115 (sealing portion) is formed in the background art as shown in FIGS. 16A and 16B (for example, see JP-A-2011-113708).

In FIGS. 16A and 16B, the reference numeral 101 represents an aluminum electric wire, and the reference numeral 102 represents a crimping terminal. The aluminum electric wire 101 is configured to include a conductor 103 made of aluminum or an aluminum alloy, and an insulating resin coating 104 covering the conductor 103. An end portion of the resin coating 104 is removed from the aluminum electric wire 101. Thus, a conductor exposed portion 105 is formed. On the other hand, the crimping terminal 102 is a female type terminal fitting, which is formed into the illustrated shape by pressing of a metal plate made of copper or a copper alloy. The crimping terminal 102 includes a rectangular cylindrical electric contact portion 106, a crimping portion 107, and a coupling portion 108 that couples the electric contact portion 106 and the crimping portion 107 with each other. A mounting portion 109, conductor crimping pieces 110 and coating crimping pieces 111 are formed in the crimping portion 107. The conductor exposed portion 105 is mounted on the mounting portion 109. The conductor exposed portion 105 mounted on the mounting portion 109 is crimped by the conductor crimping pieces 110. The resin coating 104 near the conductor exposed portion 105 is crimped by the coating crimping pieces 111.

In the above-described configuration and structure, a wire-terminal connection portion 118 is formed including a conductor crimping part 112 in which the conductor exposed portion 105 is crimped by the conductor crimping pieces 110, and a coating crimping part 113 in which the resin coating 104 near the conductor exposed portion 105 is crimped by the coating crimping pieces 111. Incidentally, in the conductor crimping part 112, a non-crimping part 114 is produced due to the relationship between the length of the conductor exposed portion 105 and the width of the conductor crimping pieces 110. Therefore, the anticorrosion portion 115 (sealing portion) is formed in the wire-terminal connection portion 118 so as to cover the non-crimping part 114. The anticorrosion portion 115 is formed of an anticorrosive material 117 (sealing material) dropping from respective nozzles 116 of two dispensers. The anticorrosive material 117 applied by dropping is then cured. Thus, the anticorrosion portion 115 is formed. Incidentally, silicone rubber is used as the anticorrosive material 117.

SUMMARY

In the above-described background-art technique, the anticorrosive material 117 is dropped from the respective nozzles 116 of the two dispensers, and the anticorrosive material 117 dropped and applied thus is cured to form the anticorrosion portion 115. According to the forming method in the background-art example, the anticorrosive material 117 is dropped from above. Therefore, there is a problem that the anticorrosion portion 115 cannot be formed sufficiently when the anticorrosive material 117 is applied unevenly.

According to an example of the uneven application, an air pocket is, for example, generated in a boundary part between the conductor exposed portion 105 and the resin coating 104, and air caused by the air pocket is caught. The air caught thus may burst when the anticorrosive material 117 is cured. In this case, there is a problem that the function of the anticorrosion portion 115 is lost.

The present invention has been made in consideration of the above-described situation. An object of the invention is to provide a method for manufacturing a terminal with an electric wire, which is high in sealing performance (high in anticorrosion and waterproofness).

In a first aspect of the invention, there is provided a method for manufacturing a terminal with an electric wire including: forming a conductor exposed portion by removing a resin coating of an electric wire; forming a wire-terminal connection portion by connecting a terminal fitting to a position of the conductor exposed portion; and supplying a sealing material from a nozzle to the wire-terminal connection portion, wherein during supply of the sealing material, the nozzle is moved in X-, Y- and Z-directions or a relative position between the wire-terminal connection portion and the nozzle is changed in the X-, Y- and Z-directions.

According to the first aspect of the invention, the sealing material can be supplied to the wire-terminal connection portion while the nozzle is, for example, moved in the X-, Y- and Z-directions. In other words, the sealing material can be supplied to the wire-terminal connection portion while fine motions are given to the nozzle. When the sealing material is supplied while fine motions are given to the nozzle, the wire-terminal connection portion can be covered with the sealing material in a state where air is hardly caught.

In a second aspect of the invention, there is provided the method for manufacturing a terminal with an electric wire according to the first aspect, wherein the wire-terminal connection portion is formed in a range including: a conductor crimping part in which the conductor exposed portion is crimped by a conductor crimping piece of the terminal fitting; a non-crimping part around the conductor crimping part; and a coating crimping part in which the resin coating in a vicinity of the conductor exposed portion is crimped by a coating crimping piece of the terminal fitting, and wherein the sealing material is supplied to cover the wire-terminal connection portion formed in the range, and during supply of the sealing material, at least in a position of the non-caulking part, the nozzle is moved in the X-, Y- and Z-directions or the relative position between the wire-terminal connection portion and the nozzle is changed in the X-, Y- and Z-directions.

According to the second aspect of the invention, the sealing material can be supplied at least to a part where an air pocket may be generated easily, while fine motions are, for example, given to the nozzle.

In a third aspect of the invention, there is provided the method for manufacturing a terminal with an electric wire according to the first or second aspect, further including: prior to supply of the sealing material, determining an initial position of the nozzle based on an image of the wire-terminal connection portion which is captured from a predetermined position by a camera.

According to the third aspect of the invention, the initial position of the nozzle can be determined. In other words, a supply start position of the sealing material can be determined.

In the first aspect of the invention, the terminal fitting may be made of a different kind of metal from the aluminum electric wire, the sealing material may be an anticorrosive material, and the sealing portion may be an anticorrosion portion. In this case, the method may be expressed as "a method for manufacturing a terminal with an electric wire including: forming a conductor exposed portion by removing an insulating resin coating of an electric wire including a conductor made of aluminum or an aluminum alloy and the resin coating covering the conductor; forming an wire-terminal connection portion by connecting a terminal fitting having a base material made of copper or a copper alloy to a position of the conductor exposed portion; and supplying an anticorrosive material from a nozzle to the wire-terminal connection portion in order to form an anticorrosion portion covering the wire-terminal connection portion, wherein during supply of the anticorrosive material, the nozzle is moved in X-, Y- and Z-directions or a relative position between the wire-terminal connection portion and the nozzle is changed in the X-, Y- and Z-directions."

Alternatively, in the first aspect of the invention, the sealing material may be a waterproofing material, and the sealing portion may be a waterproof portion. That is, the method may be expressed as "a method for manufacturing a terminal with an electric wire including: forming a conductor exposed portion by removing a resin coating of an electric wire; forming a wire-terminal connection portion by connecting a terminal fitting to a position of the conductor exposed portion; and supplying a waterproofing material from a nozzle to the wire-terminal connection portion, wherein during supply of the waterproofing material, the nozzle is moved in X-, Y- and Z-directions or a relative position between the wire-terminal connection portion and the nozzle is changed in the X-, Y- and Z-directions."

According to the first aspect of the invention, the sealing material is supplied to the wire-terminal connection portion while the nozzle is, for example, moved in the X-, Y- and Z-directions. Accordingly, it is a matter of course that a state in which the sealing material is supplied can be improved. As a result, there is an advantage that uneven application of the sealing material can be prevented. In addition, there is another advantage that air can be prevented from being caught, and the air can be prevented from bursting when the sealing material is cured. Therefore, according to the first aspect of the invention, there is an advantage that it is possible to provide a method for manufacturing a terminal with an electric wire, high in sealing performance (high in anticorrosion or waterproofness).

According to the second aspect of the invention, the wire-terminal connection portion is formed to include the conductor crimping part, the non-crimping part around the conductor crimping part, and the coating crimping part, whereby the wire-terminal connection portion is covered with the sealing portion. Accordingly, there is an advantage that the sealing portion can be formed to cover a wider range than in the background-art example. In addition, according to the second aspect of the invention, the nozzle is, for example, moved in the X-, Y- and Z-directions at least in a position of the non-crimping part during supply of the sealing material. Accordingly, there is an advantage that uneven application can be surely prevented in the part where an air pocket may be generated easily. Thus, according to the second aspect of the invention, there is an advantage that it is possible to provide a method for manufacturing a terminal with an electric wire, high in sealing performance (high in anticorrosion or waterproofness).

According to the third aspect of the invention, supplying the sealing material to the wire-terminal connection portion can be always started in one and the same position. Accordingly, there is an advantage that the sealing portion can be formed stably.

BRIEF DESCRIPTION OF THE DRAWINGS

FIGS. 8A and 8B are explanatory views as to supply of an anticorrosive material, in which FIG. 8A is a view as to supply to a coating crimping part, and FIG. 8B is a view as to supply to a non-crimping part.

FIGS. 9A and 9B are explanatory views as to supply of the anticorrosive material, in which FIG. 9A is a view as to supply to a conductor crimping part, and FIG. 9B is a view as to supply to a front side of the conductor crimping part.

FIGS. 10A and 10B are explanatory views as to a modification of FIGS. 8A and 8B and FIGS. 9A and 9B, in which FIG. 10A is a view as to supply to the non-crimping part, and FIG. 10B is a view as to supply to the conductor crimping part.

FIGS. 12 A and 12B are views of a connector housing in FIG. 11, in which

FIGS. 14A and 14B are views showing photographing ranges of cameras in FIG. 13, in which FIG. 14A is a view of the photographing range of an upper surface, and FIG. 14B is a view of the photographing range of a side surface.

FIGS. 15A and 15B are views showing an initial position of a nozzle made of metal in FIG. 13, in which FIG. 15A is a view in which height of the coating crimping part is low, and FIG. 15B is a view in which the height is high.

FIGS. 16A and 16B are views of a terminal with an electric wire in a background-art example, in which FIG. 16A is a perspective view, and FIG. 16B is a sectional view taken on line D-D.

DETAILED DESCRIPTION

A terminal with an electric wire is configured to include an aluminum electric wire and a crimping terminal. The aluminum electric wire is configured to include a conductor made of aluminum or an aluminum alloy, and an insulating resin coating covering the conductor. The resin coating is removed from the aluminum electric wire to form a conductor exposed portion (electric wire processing step). The crimping terminal includes a crimping portion as a crimping part. Conductor crimping pieces and coating crimping pieces are formed in the crimping portion. In the terminal with the electric wire, the crimping portion is crimped to the conductor exposed portion to form a wire-terminal connection portion (a wire-terminal connecting step). Then, an anticorrosive material is supplied from a nozzle to the wire-terminal connection portion in order to form an anticorrosion portion covering the wire-terminal connection portion (anticorrosive material supplying step). When the anticorrosive material is being supplied, the nozzle is moved in X-, Y- and Z-directions, or the relative position between the wire-terminal connection portion and the nozzle is changed in the X-, Y- and Z-directions. The anticorrosive material is supplied thus.

Figure 1:
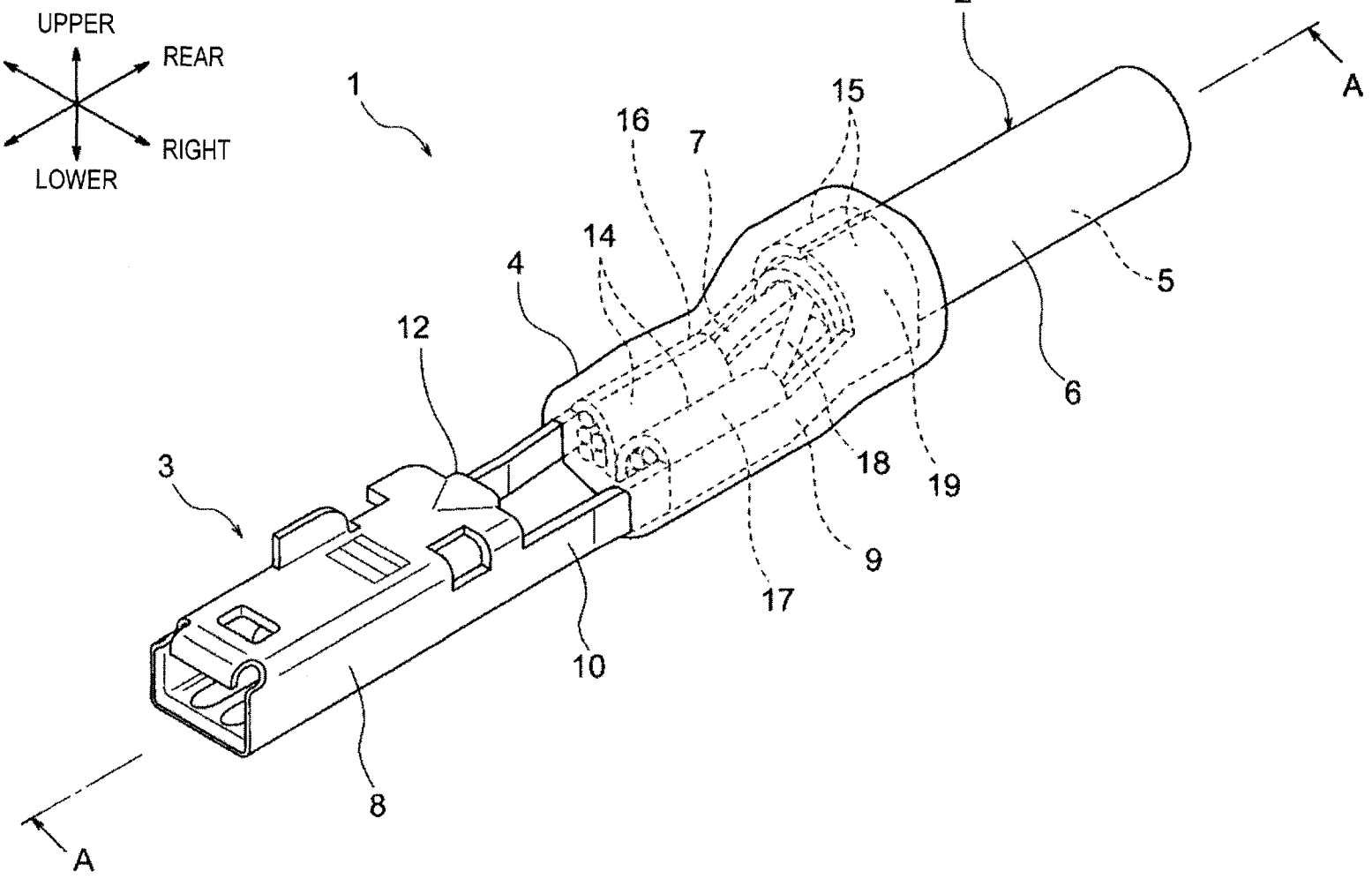
FIG. 1 is a perspective view showing a terminal with an electric wire.
Figure 2:
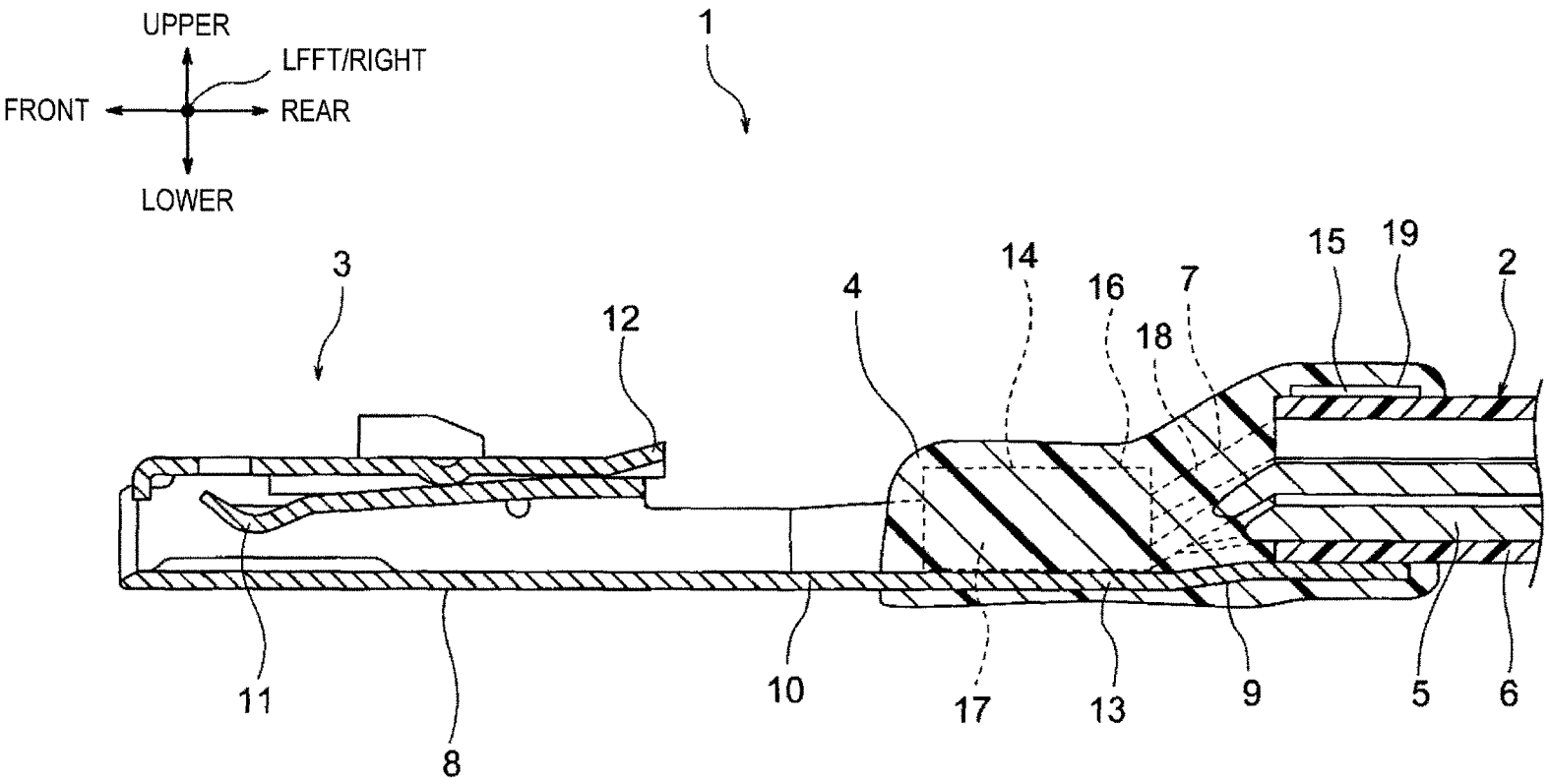
FIG. 2 is a sectional view taken on line A-A in FIG. 1.
Figure 3:
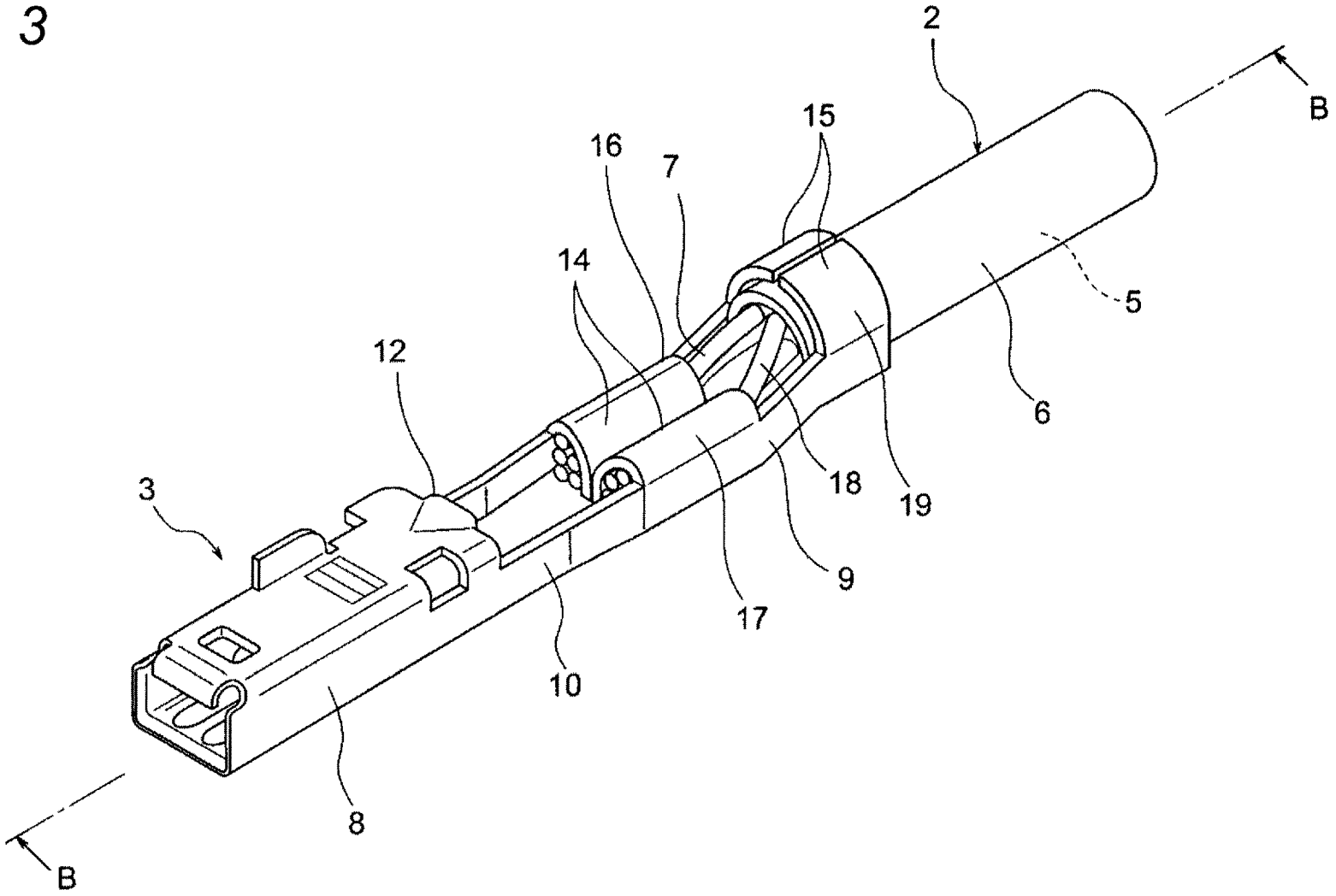
FIG. 3 is a perspective view showing a terminal with an electric wire, in which an anticorrosion portion has not been formed yet.
Figure 4:
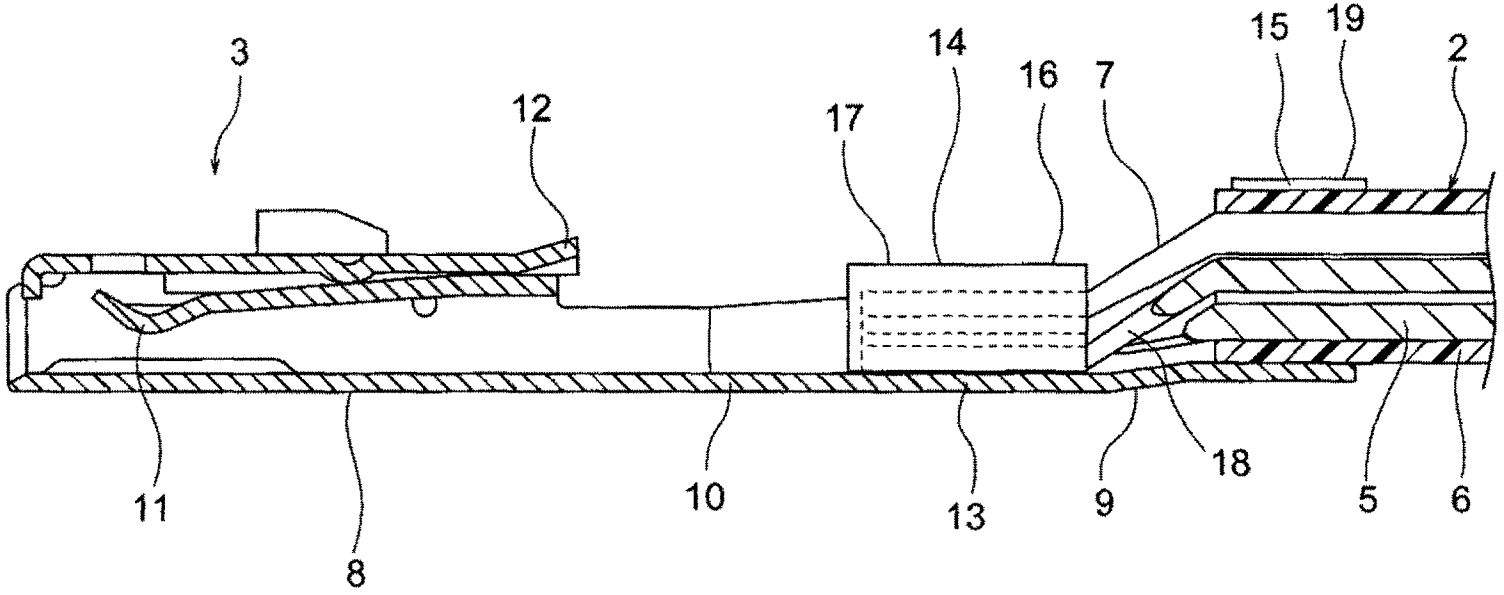
FIG. 4 is a sectional view taken on line B-B in FIG. 3.
Figure 5:
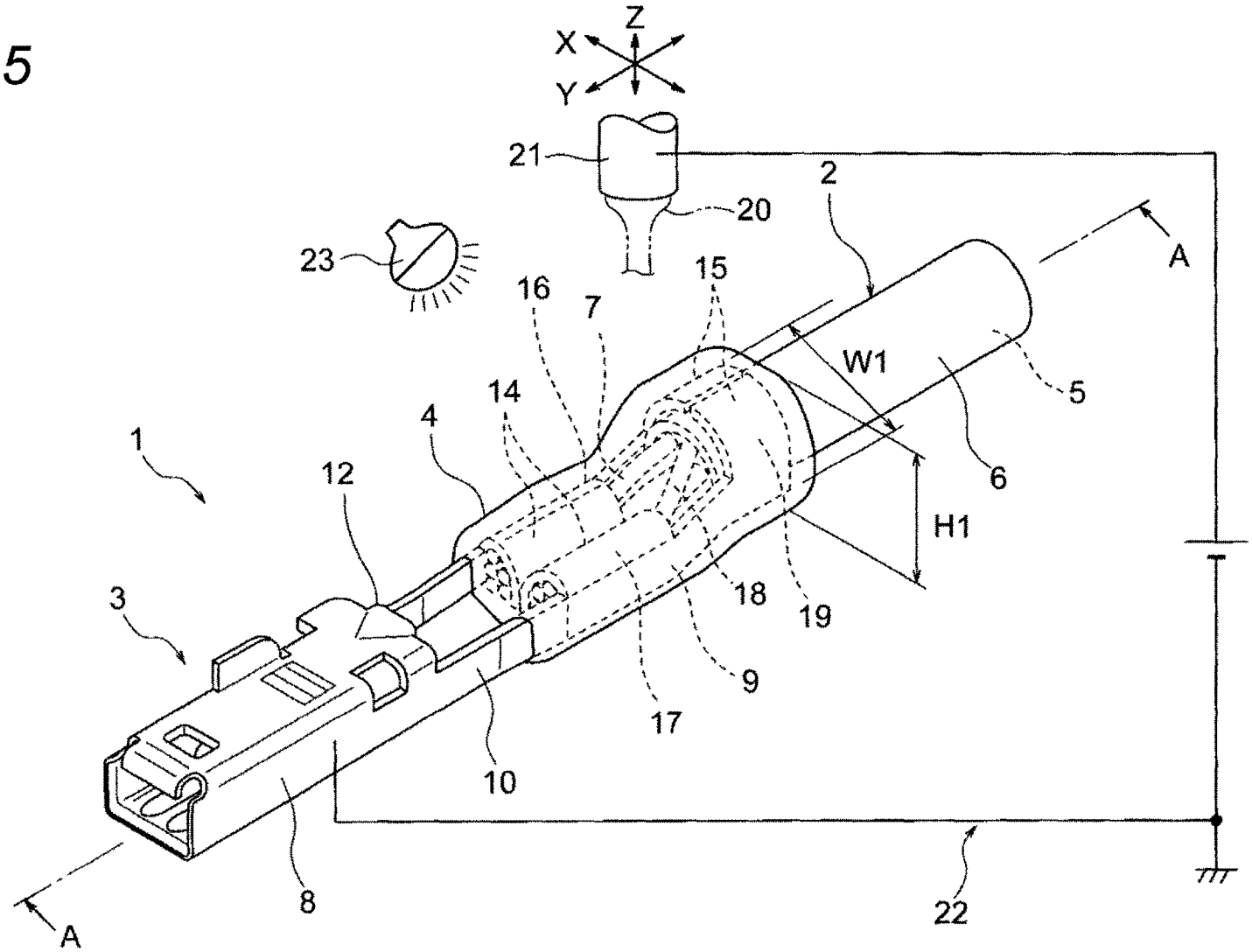
FIG. 5 is a perspective view for explaining a method for manufacturing a terminal with an electric wire according to an embodiment of the invention.
Figure 6:
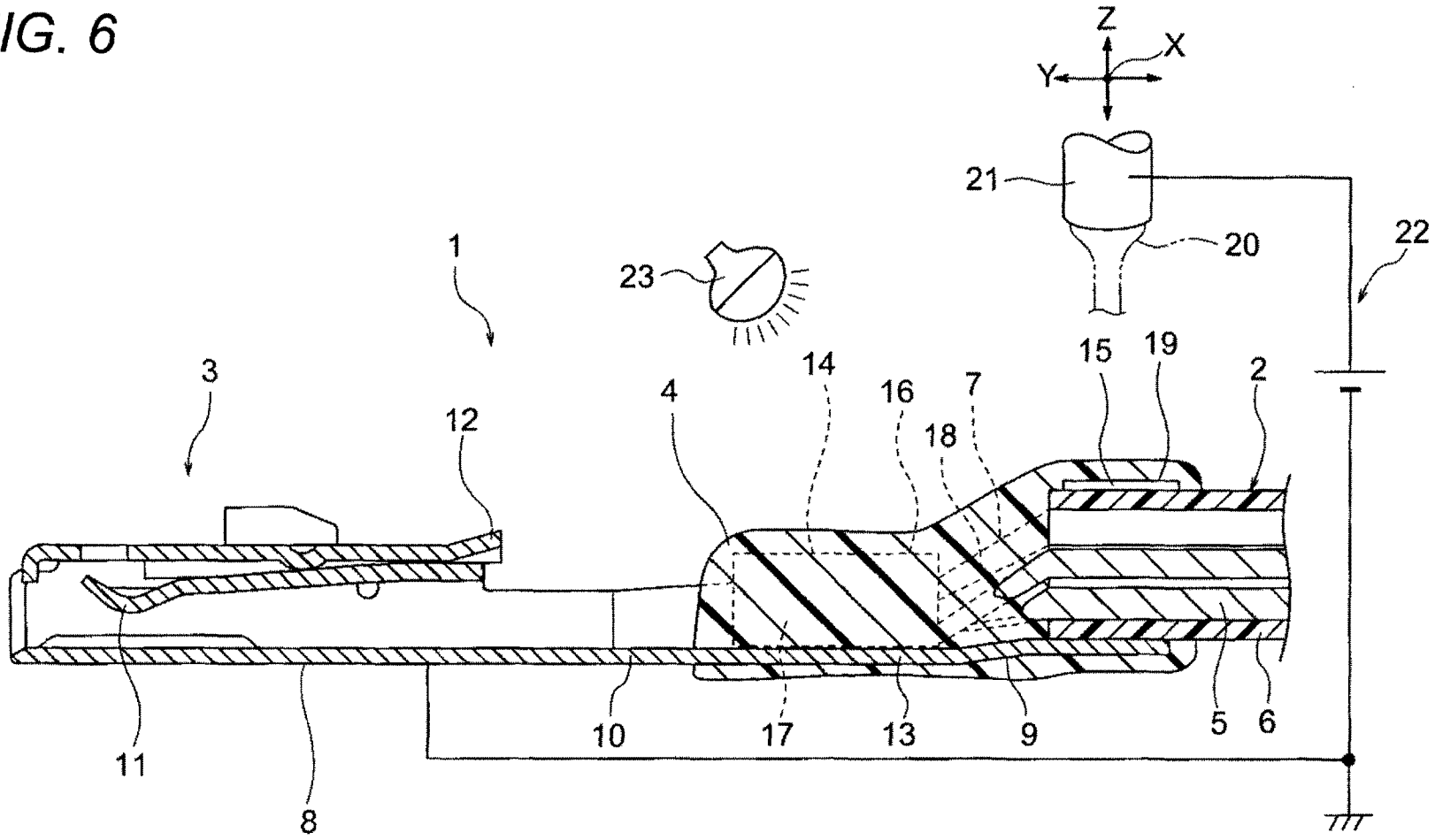
FIG. 6 is a sectional view taken on line A-A in FIG. 5.
Figure 7:
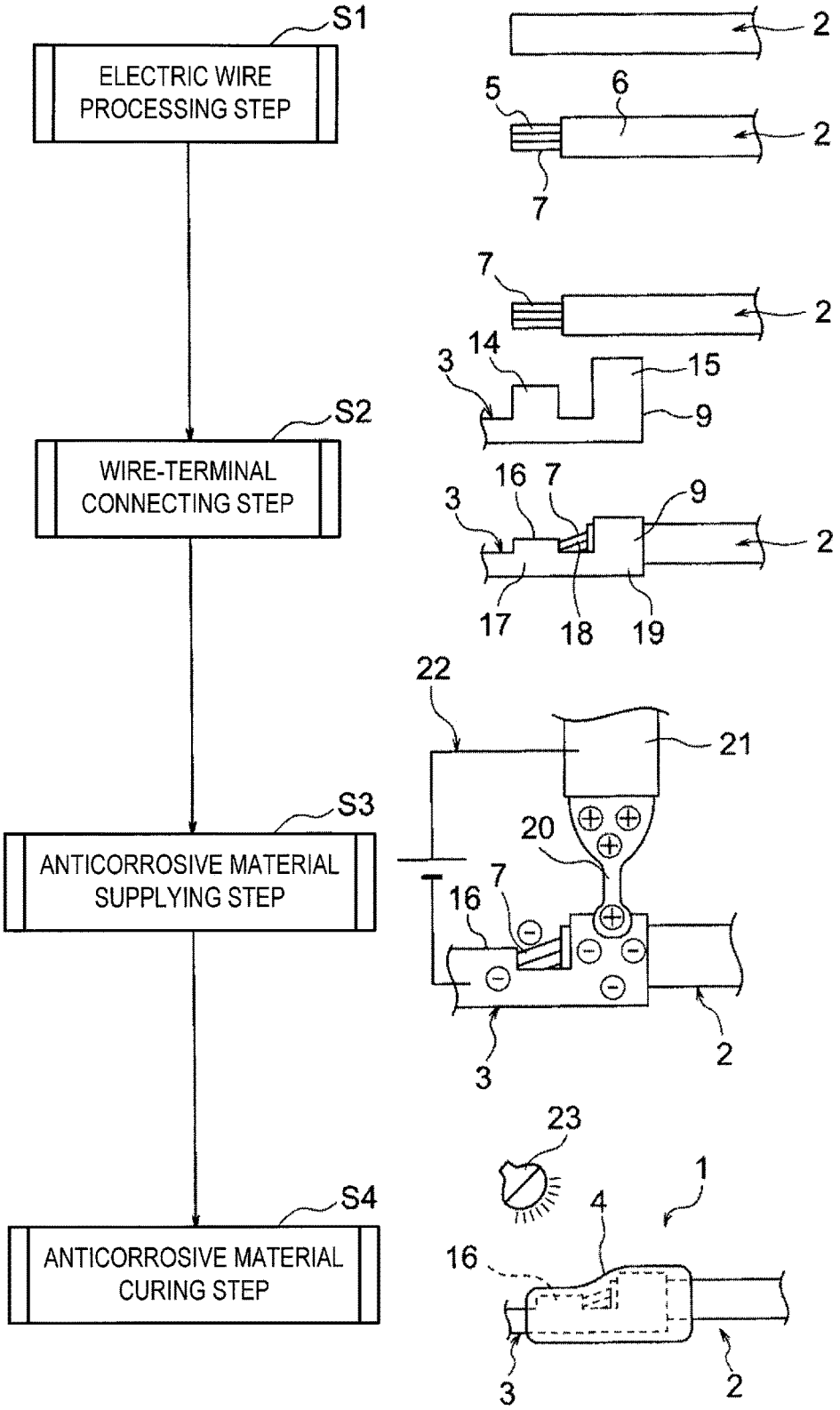
FIG. 7 is a diagram for explaining steps in the method for manufacturing a terminal with an electric wire according to the embodiment of the invention.
Figure 10A:
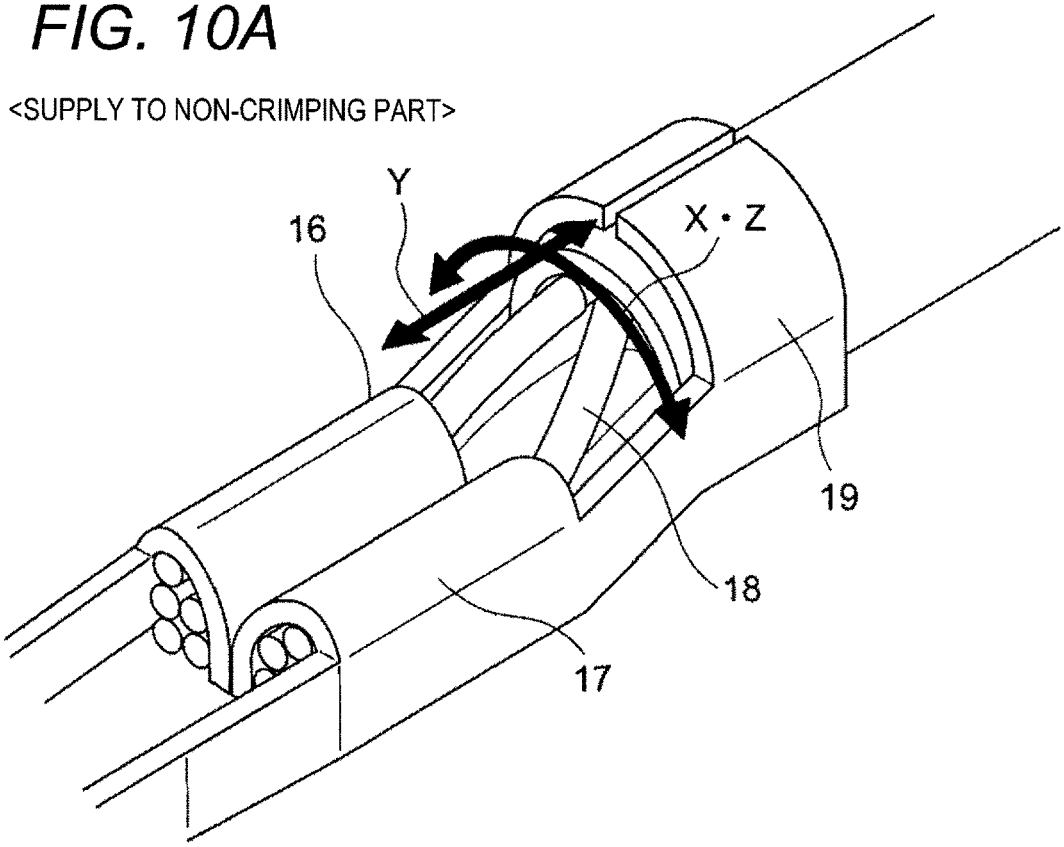
Figure 10B:
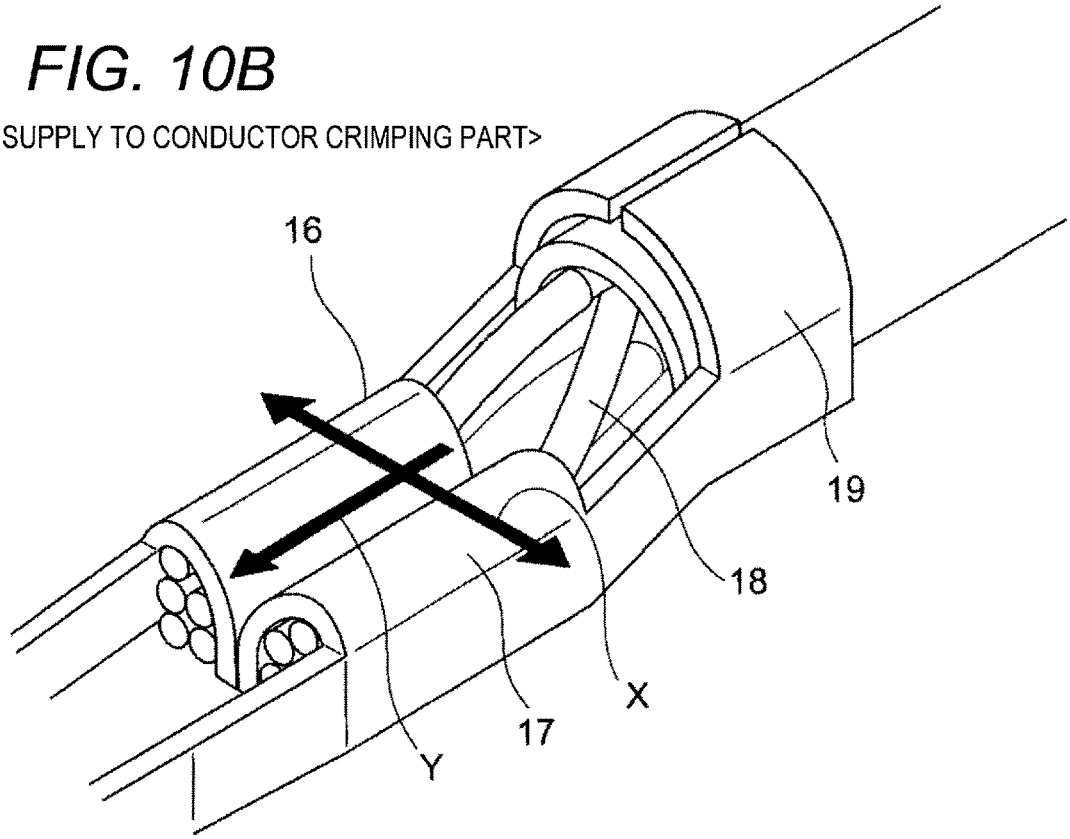
Figure 11:
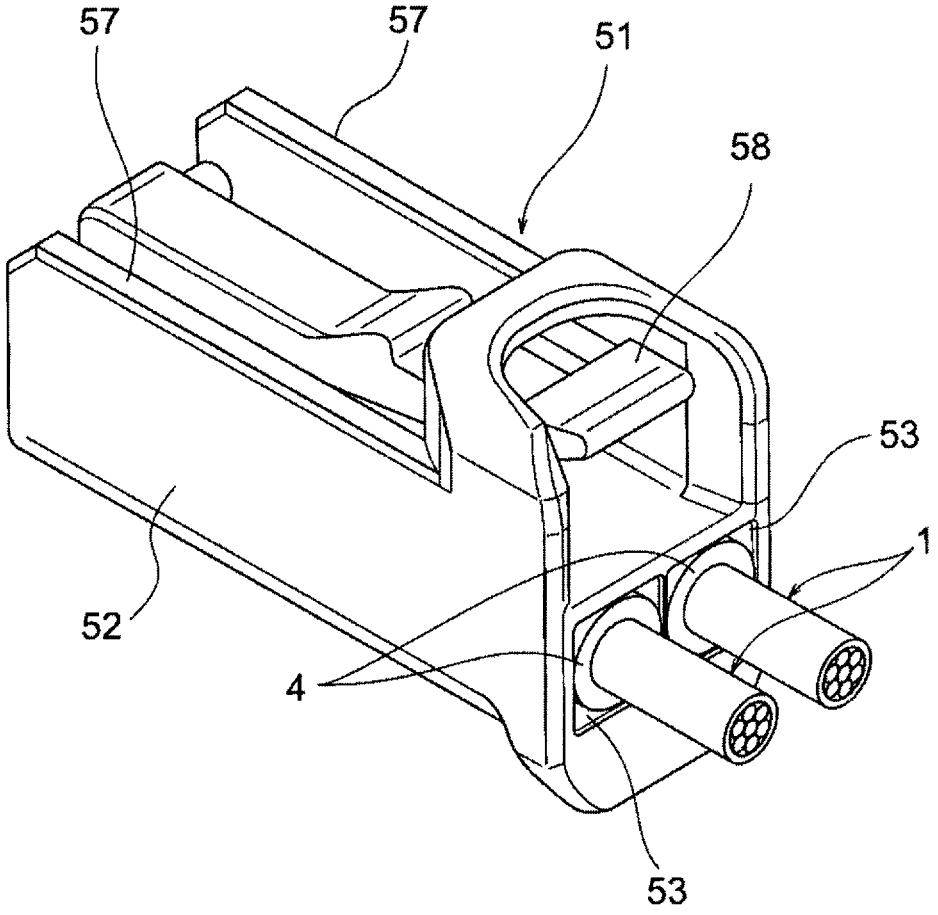
FIG. 11 is a perspective view of a connector constituting a wire harness.
Figure 12A:
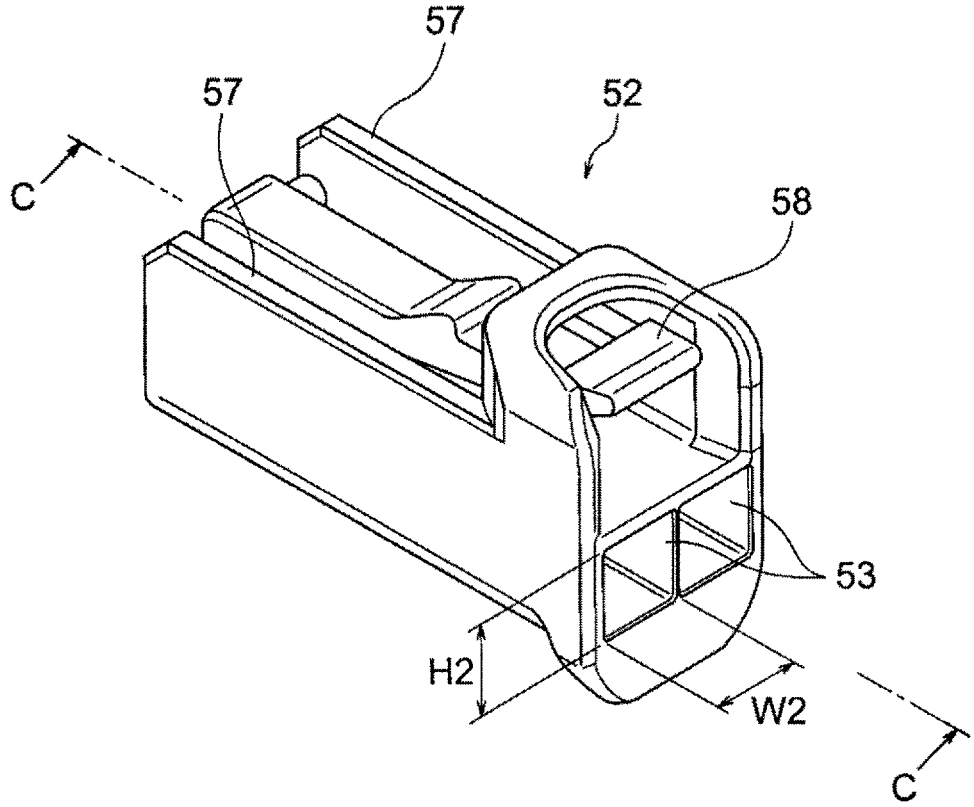
FIG. 12A is a perspective view.
Figure 12B:
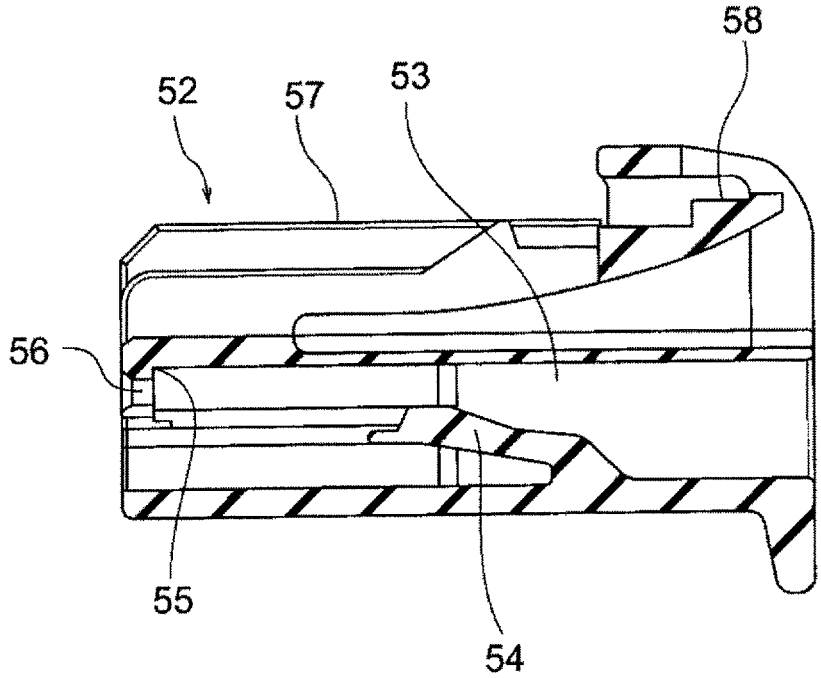
FIG. 12B is a sectional view taken on line C-C.

An embodiment will be described below with reference to the drawings. FIG. 1 is a perspective view showing a terminal with an electric wire. FIG. 2 is a sectional view taken on line A-A in FIG. 1. FIG. 3 is a perspective view showing a terminal with an electric wire, in which an anticorrosion portion has not been formed yet. FIG. 4 is a sectional view taken on line B-B in FIG. 3. FIG. 5 is a perspective view for explaining a method for manufacturing a terminal with an electric wire according to an embodiment of the invention. FIG. 6 is a sectional view taken on line A-A in FIG. 5. FIG. 7 is a diagram for explaining steps in the method for manufacturing a terminal with an electric wire according to the embodiment of the invention. FIGS. 8A to 10B are explanatory views as to supply of an anticorrosive material. FIG. 11 is a perspective view of a connector constituting a wire harness. FIGS. 12A and 12B are views of a connector housing in FIG. 11.

<Configuration of Terminal 1 with Electric Wire>

In FIG. 1 and FIG. 2, the reference numeral 1 represents a terminal with an electric wire. The terminal 1 with an electric wire is configured to include an aluminum electric wire 2 (electric wire), and a crimping terminal 3 (terminal fitting) disposed at a terminal end of the aluminum electric wire 2. In addition, the terminal 1 with an electric wire is configured to include an anticorrosion portion 4 (sealing portion, waterproof portion) in a part where different kinds of metals are connected with each other between the aluminum electric wire 2 and the crimping terminal 3. Incidentally, although the crimping terminal 3 is disposed at the terminal end of the aluminum electric wire 2 in the terminal 1 with an electric wire according to the embodiment, a terminal fitting having a suitable shape may be, for example, disposed in the middle of the aluminum electric wire 2.

<Configuration and Structure of Aluminum Electric Wire 2>

In FIG. 1 to FIG. 4, an aluminum electric wire that has a circular shape in section and that is soft enough to generate a reaction force to return to its original shape when a bending force is applied thereto is used as the aluminum electric wire 2. The aluminum electric wire 2 is configured to include a conductor 5 and a resin coating 6.

The conductor 5 is formed by twisting a plurality of strands (with no reference sign) each having a circular shape in section. The strands are made of aluminum or an aluminum alloy. That is, the conductor 5 is made of aluminum or an aluminum alloy. The conductor 5 has a predetermined conductor sectional area. A part having the conductor sectional area extends correspondingly to the electric wire length of the aluminum electric wire 2. The specific gravity of an aluminum material is 2.70 g/cm$^3$. The specific gravity of a copper material that will be described later is 8.96 g/cm$^3$. Therefore, the aluminum electric wire 2 is so light that fuel efficiency etc. can be improved effectively when the aluminum electric wire 2 is used as a long in-vehicle electric wire.

Incidentally, the aluminum material has a standard electrode potential of −1.676 V in an electrochemical reaction. On the other hand, the copper material that will be described later has a standard electrode potential of +0.340 V. Due to a large potential difference between those materials, a cell is formed out of aluminum, copper and an electrolytic aqueous solution when water enters and stays between the aluminum material and the copper material. Then, contact corrosion of different kinds of metals (galvanic corrosion, electric corrosion) occurs on the side serving as an anode of the cell, that is, on the conductor 5 side. For such a reason, it is a matter of course that the anticorrosion portion 4 is required for preventing the electric corrosion.

The resin coating 6 is a so-called insulator, which is formed into a circular shape in section by extrusion molding of an insulating resin material to the outside of the conductor 5. Various known kinds of resin materials may be used as the resin material. For example, the resin material may be selected suitably from polymer materials such as polyvinyl chloride resin, polyethylene resin, polypropylene resin, etc.

In the aluminum electric wire 2 configured thus, the resin coating 6 is removed at a terminal end thereof by a predetermined length to form a conductor exposed portion 7.

<Structure of Crimping Terminal 3>

In FIG. 1 to FIG. 4, the crimping terminal 3 is a female type terminal fitting, which is, for example, formed into the illustrated shape by pressing of a metal plate whose base material is made of copper or a copper alloy (it is noted that the crimping terminal 3 may be a male type terminal fitting). Incidentally, although not shown, plating is applied to the surface of the base material. The plating intervenes in a contact part of different kinds of metals between the copper material and the aluminum material. The crimping terminal 3 includes an electric contact portion 8, a crimping portion 9, and a coupling portion 10 coupling the electric contact portion 8 and the crimping portion 9 with each other.

The electric contact portion 8 is an electric connection part with a not-shown mating terminal fitting. The electric contact portion 8 is formed into a cylindrical shape that is rectangular in section. An insertion space in which a tab of the mating terminal fitting can be inserted is formed inside the electric contact portion 8. In addition, an elastic contact piece 11 is formed so that the electric contact piece 11 can make elastic contact with the tab when the tab is inserted. The reference numeral 12 in the electric contact portion 8 represents a locked portion that can be caught and locked to a lance 54 of a connector housing 52, which will be described later.

The crimping portion 9 is an electric connection part with the aluminum electric wire 2. Since the terminal fitting according to the embodiment serves as the crimping terminal 3, the crimping portion 9 is formed in a part that can be connected to the aluminum electric wire 2 by crimping. Specifically, the crimping portion 9 is formed in a part including a mounting portion 13, a pair of conductor crimping pieces 14 and a pair of coating crimping pieces 15. The conductor exposed portion 7 of the aluminum electric wire 2 is mounted on the mounting portion 13. The conductor exposed portion 7 mounted on the mounting portion 13 is crimped by the conductor crimping pieces 14. The resin coating 6 near the conductor exposed portion 7 is crimped by the coating crimping pieces 15. Incidentally, the mounting portion 13 may be also referred to as a bottom plate. In addition, the conductor crimping pieces 14 may be also referred to as wire barrels. Further, the coating crimping pieces 15 may be also referred to as insulation barrels.

The pair of conductor crimping pieces 14 and the pair of coating crimping pieces 15 are disposed at a predetermined interval in an axial direction of the terminal. In addition, the pair of conductor crimping pieces 14 and the pair of coating crimping pieces 15 are formed into substantially V-shapes as their shapes before crimping. Incidentally, the pair of conductor crimping pieces 14 crimp the conductor exposed portion 7, and the pair of coating crimping pieces 15 crimp the resin coating 6. Therefore, those pieces are formed with different widths and different protruding lengths in accordance with a difference in shape or outer circumferential length between objects to be crimped by the pieces respectively.

When the conductor exposed portion 7 is crimped to the crimping portion 9 configured thus, a wire-terminal connection portion as represented by the reference numeral 16 is formed. The wire-terminal connection portion 16 is formed including a conductor crimping part 17 in which the conductor exposed portion 7 is crimped by the pair of conductor crimping pieces 14, a non-crimping part 18 around the conductor crimping part 17, and a coating crimping part 19 in which the resin coating 6 near the conductor exposed portion 7 is crimped by the pair of coating crimping pieces 15.

The coupling portion 10 is formed into a substantially gutter-like shape extending with a predetermined length in the axial direction of the terminal. The electric contact portion 8 is continuously connected to one end of the coupling portion 10 in the axial direction of the terminal. In addition, the crimping portion 9 is continuously connected to the other end of the coupling portion 10 in the axial direction of the terminal.

<Anticorrosion Portion 4>

In FIG. 1 and FIG. 2, the anticorrosion portion 4 is formed as a part that can watertightly cover the wire-terminal connection portion 16 in order to prevent electric corrosion. Specifically, on the assumption that the illustrated arrows are defined as upper/lower, left/right, and front/rear, the anticorrosion portion 4 is formed as a part covering the upper side of the crimping portion 9 (the upper side of the conductor crimping part 17 and the upper side of the non-crimping part 18), the lower side of the crimping portion 9 (the lower side of the mounting portion 13), the left and right sides of the crimping portion 9, the front side of the crimping portion 9 (the front side of the conductor crimping part 17), and the rear side of the coating crimping part 19. To say other words, the anticorrosion portion 4 is formed as a part covering the front and rear of the wire-terminal connection portion 16, and the whole circumference of the wire-terminal connection portion 16 around the axis of the terminal.

<Method for Manufacturing Terminal 1 with Electric Wire>

In FIG. 5 to FIG. 7, the terminal 1 with an electric wire is manufactured through the following steps. That is, the terminal 1 with an electric wire is manufactured through a sequence of an electric wire processing step S1, a wire-terminal connecting step S2, an anticorrosive material supplying step S3 (sealing material supplying step, waterproofing material supplying step), and an anticorrosive material curing step S4 (sealing material curing step, waterproofing material curing step). The anticorrosive material supplying step S3 and the anticorrosive material curing step S4 are steps (forming method) for forming the anticorrosion portion 4. Incidentally, as will be described later as to a modification, it is noted that the terminal 1 with an electric wire may be manufactured by the steps in which a nozzle initial position determining step has been added between the wire-terminal connecting step S2 and the anticorrosive material supplying step S3.

In the electric wire processing step S1, the conductor exposed portion 7 is formed at the terminal end of the aluminum electric wire 2. Specifically, the resin coating 6 is removed by a predetermined length to expose the conductor 5. Thus, the conductor exposed portion 7 is formed.

In the wire-terminal connecting step S2, the crimping portion 9 of the crimping terminal 3 is disposed in a position of the conductor exposed portion 7, and the wire-terminal connection portion 16 is then formed by crimping connection. In the crimping, pressing is performed by an anvil and a crimper of a crimping machine. That is, crimping is performed. When the conductor exposed portion 7 is crimped to the crimping portion 9, the conductor crimping part 17, the non-crimping part 18 and the coating crimping part 19 are formed.

In the anticorrosive material supplying step S3, the anticorrosive material 20 (sealing material, waterproofing material) is supplied to the wire-terminal connection portion 16. In the anticorrosive material supplying step S3, an anticorrosive material supplying apparatus having the following configuration is used. The anticorrosive material supplying apparatus is configured to include a dispenser (dispenser also using static electricity) having a metal nozzle 21, a voltage applying portion 22 for applying a voltage between the metal nozzle 21 and the crimping terminal 3, and a control portion for controlling the dispenser and the voltage applying portion 22.

A liquid ultraviolet-curing resin is used as the anticorrosive material 20. When a voltage is applied between the metal nozzle 21 and the crimping terminal 3, positive charges are induced on the liquid surface of the anticorrosive material 20. Incidentally, the voltage applied between the metal nozzle 21 and the crimping terminal 3 is about 3 kV in the embodiment. On the other hand, negative charges are induced on the crimping terminal 3 side.

When the voltage is applied between the metal nozzle 21 and the crimping terminal 3, the liquid interface of the anticorrosive material 20 is pulled in the direction of an electric line of force by an electrostatic force. That is, the anticorrosive material 20 that has been charged is attracted in a direction from the metal nozzle 21 toward the wire-terminal connection portion 16. When the anticorrosive material 20 is pulled (attracted), the anticorrosive material 20 comes into contact with the wire-terminal connection portion 16 without wetting-up from a tip portion of the metal nozzle 21. Specifically the anticorrosive material 20 is stretched continuously substantially like a string to a part where an electric field is concentrated, and the anticorrosive material 20 stretched thus comes into contact with the wire-terminal connection portion 16.

In the anticorrosive material supplying step S3, the metal nozzle 21 is moved in the directions of the arrows X, Y and Z in FIG. 5 and FIG. 6 when the anticorrosive material 20 is being supplied. Alternatively, the relative position between the wire-terminal connection portion 16 and the metal nozzle 21 is changed in the X-, Y- and Z-directions. Incidentally, these features come from the manufacturing method according to an embodiment of the invention. Details will be described later with reference to FIGS. 5 and 6, and FIGS. 8A to 10B.

The anticorrosive material 20 that has been charged is supplied. Accordingly, the charged anticorrosive material 20 is attracted to the wire-terminal connection portion 16 by an electrostatic force, and then supplied in a state where the anticorrosive material 20 can turn around the opposite side to a position from which the anticorrosive material 20 is supplied. That is, even when the anticorrosive material 20 is supplied from above, the anticorrosive material 20 can turn around the lower side of the wire-terminal connection portion 16 so as to be supplied to the whole circumference of the wire-terminal connection portion 16. Since an attractive force caused by the electrostatic force acts on the anticorrosive material 20 supplied to the whole circumference of the wire-terminal connection portion 16, the anticorrosive material 20 can stay at that place without dripping. In addition, the anticorrosive material 20 can permeate the strands of the conductor 5 in the non-crimping part 18 and stay therein.

In the anticorrosive material curing step S4, the anticorrosive material 20 supplied to the whole circumference of the wire-terminal connection portion 16 is irradiated with ultraviolet rays (UV light) and UV-cured. The anticorrosive material 20 is made of liquid ultraviolet-curing resin. Accordingly, when the anticorrosive material 20 suffers energy due to irradiation with ultraviolet rays, for example, from a UV light 23, the anticorrosive material 20 can be cured in a short time while keeping the above-described staying state. When the anticorrosive material 20 is cured, the anticorrosion portion 4 watertightly covering the wire-terminal connection portion 16 is completely formed. That is, the terminal 1 with an electric wire is completely manufactured.

As is understood from the above description, the anticorrosion portion 4 can be formed in a satisfactory state. In addition, the anticorrosion portion 4 can be formed into a shape having a maximum width of W1 and a maximum height of H1. This is because the anticorrosive material 20 is supplied in a string-like state as described above so that the feed rate thereof can be controlled accurately, with the result that the shape of the anticorrosion portion 4 can be stabilized. The stabilized shape of the anticorrosion portion 4 is effective in installing a connector 51 (see FIG. 11), which will be described later.

<Feature in Supply of Anticorrosive Material 20>

In FIG. 5 and FIG. 6, the manufacturing method according to an embodiment of the invention is characterized in that the anticorrosive material 20 is supplied while the metal nozzle 21 is moved in the directions of the arrows X, Y and Z. Alternatively, the manufacturing method according to an embodiment of the invention is characterized in that the anticorrosive material 20 is supplied while a not-shown XY table to which the crimping terminal 3 has been fixed is moved in the X- and Y-directions and the metal nozzle 21 is moved in the Z-direction in accordance with necessity. Incidentally, it is assumed that a not-shown control apparatus is provided so that the movement in the X-, Y- and Z-directions can be controlled by the control apparatus.

Figure 8A:
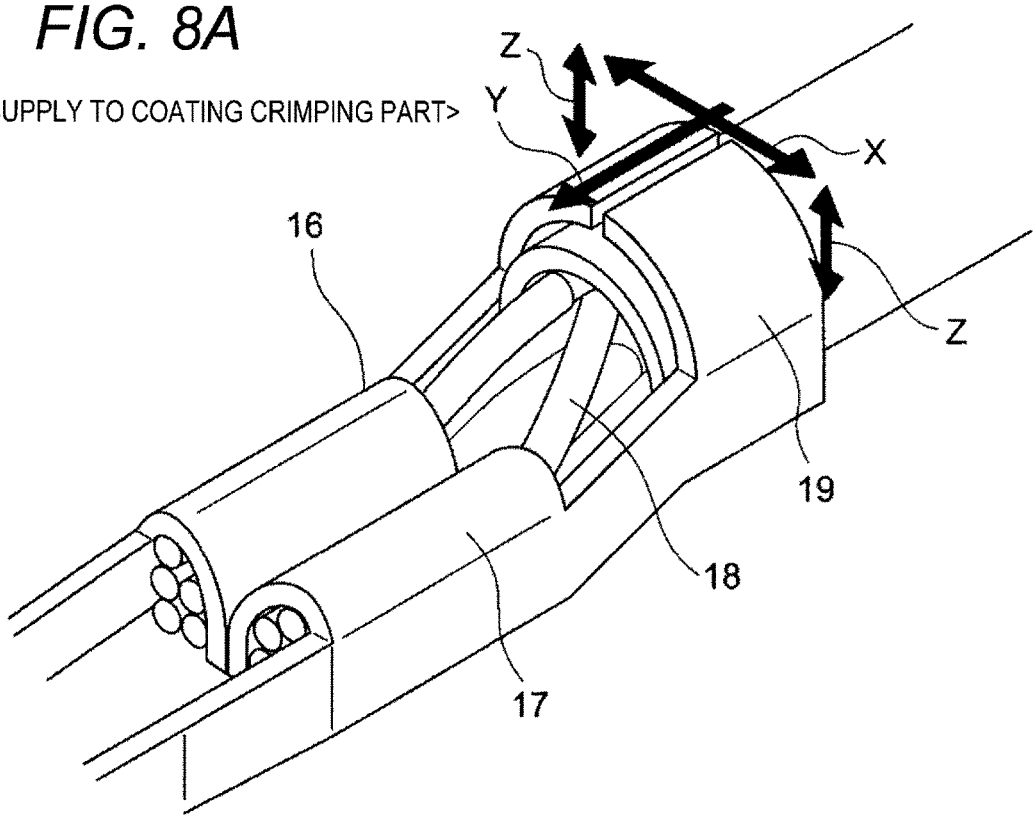

Some more details about the supply of the anticorrosive material 20 will be described with reference to FIG. 8A (assume that the description here is an example). First, the metal nozzle 21 is disposed on the rear side of the coating crimping part 19. Next, supplying the anticorrosive material 20 is started. When supplying the anticorrosive material 20 is started, the metal nozzle 21 moves gradually in the direction of the arrows Y (frontward) while swinging in the direction of the arrows X (moving in the left/right direction). Incidentally, the metal nozzle 21 may move further in the Z-direction (downward) while swinging in the direction of the arrows X. This is effective particularly when the height of the coating crimping part 19 is higher. With the movement in the X- and Y-directions (or with the movement in the X-, Y- and Z-directions), the coating crimping part 19 is completely covered with the anticorrosive material 20 (see FIG. 5 and FIG. 6).

Figure 8B:
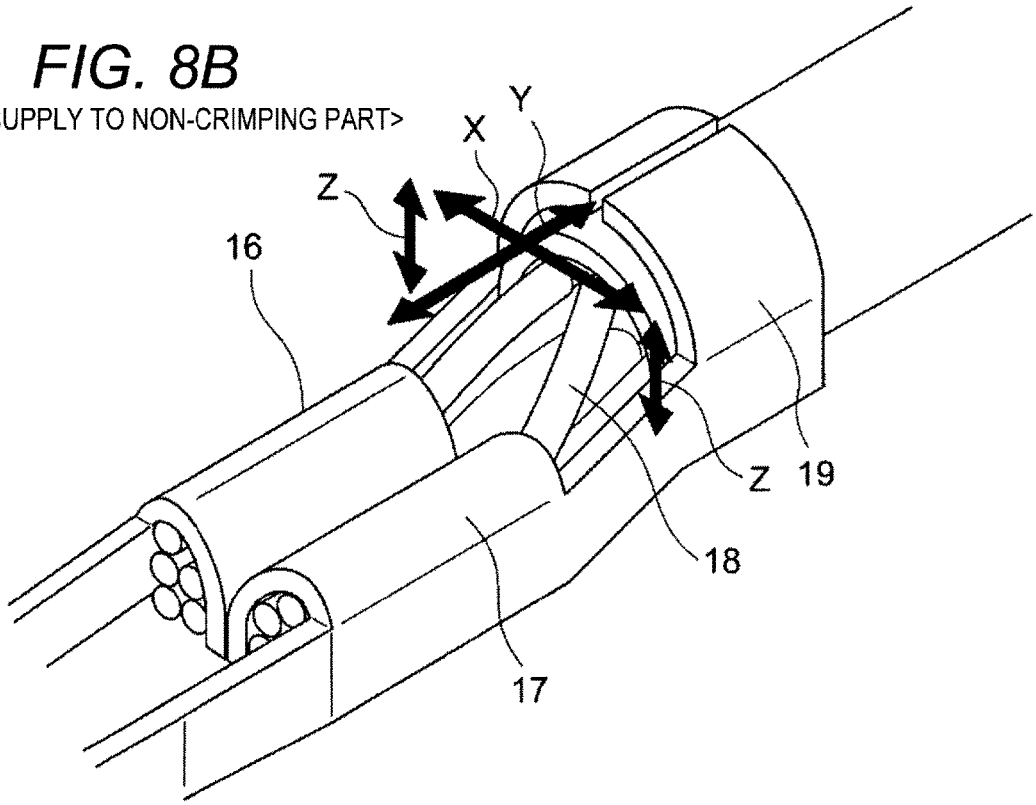

In FIG. 8B, the metal nozzle 21 that has moved from the coating crimping part 19 side also moves in the Z-direction above the non-crimping part 18 while swinging in the direction of the arrows X. Then, the metal nozzle 21 also moves gradually in the direction of the arrows Y. Specifically, the metal nozzle 21 moves downward after swinging leftward. Then, returning to the upper side immediately, the metal nozzle 21 swings rightward this time, then moves downward, and returns to the upper side immediately. Repeating such motions, the metal nozzle 21 moves gradually in the direction of the arrows Y (incidentally, the movement in the Y-direction is not limited to movement to the front, but may include fine motions to the front and the rear, in which the metal nozzle 21 returns backward slightly and then moves forward. Further, the movement in the X- and Z-directions may include movement substantially like an arc as shown by the arrows in FIG. 10A). With the movement in the X-, Y- and Z-directions, the non-crimping part 18 is completely covered with the anticorrosive material 20 (see FIG. 5 and FIG. 6).

Figure 9A:
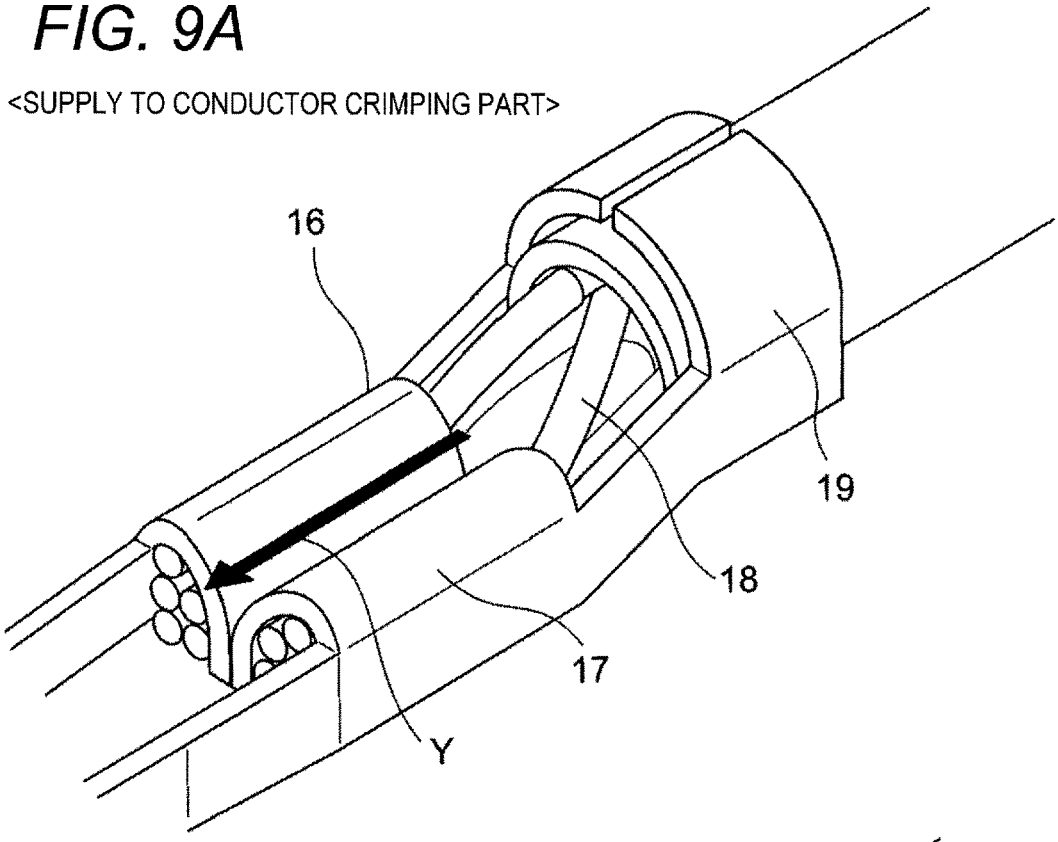

In FIG. 9A, the metal nozzle 21 that has moved from the non-crimping part 18 side moves in the direction of the arrows Y above the conductor crimping part 17. Incidentally, here, the anticorrosive material 20 is supplied with the metal nozzle 21 moving only in the direction of the arrows Y. However, the anticorrosive material 20 may be supplied with the metal nozzle 21 moving gradually in the direction of the arrows Y (frontward) while swinging in the direction of the arrows X as shown in FIG. 10B. The conductor crimping part 17 is partially or entirely covered with the anticorrosive material 20 (see FIG. 5 and FIG. 6).

Figure 9B:
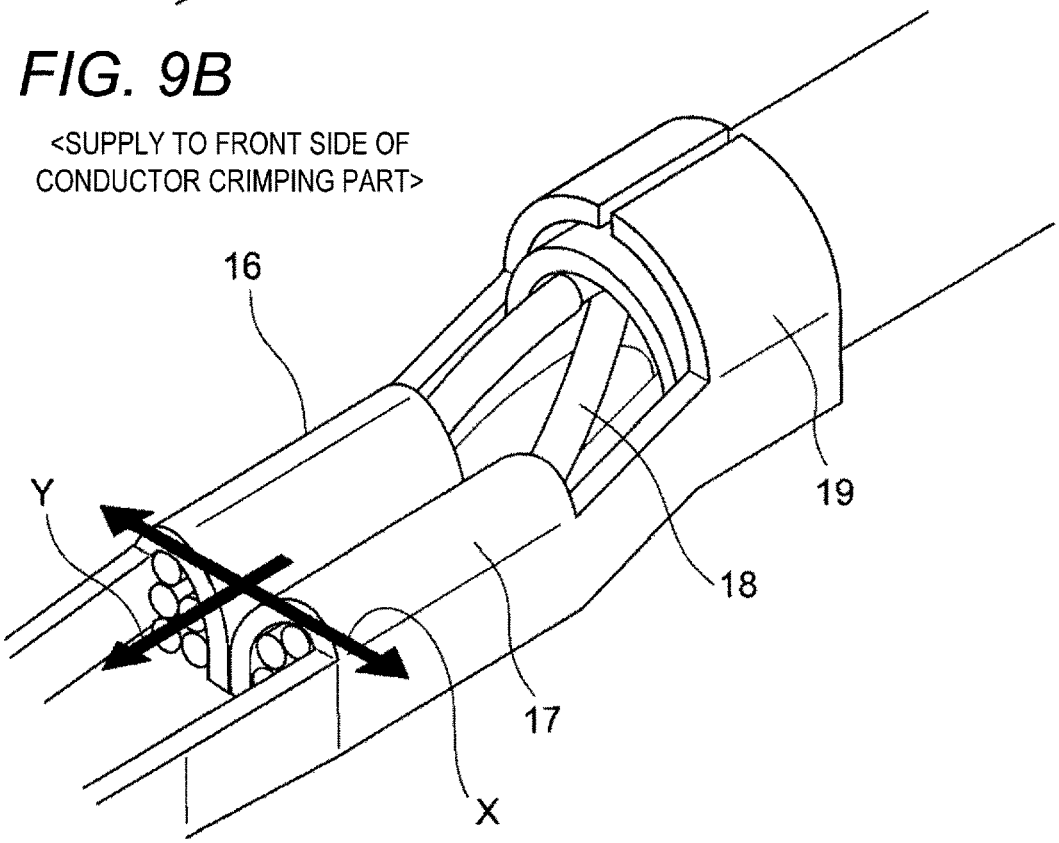

In FIG. 9B, finally, the metal nozzle 21 that has moved to the front side of the conductor crimping part 17 moves slightly in the direction of the arrows Y (frontward) while swinging in the direction of the arrows X. The front side of the conductor crimping part 17 is completely covered with the anticorrosive material 20 (see FIG. 5 and FIG. 6).

As is understood from the above description, the anticorrosive material 20 is supplied to the wire-terminal connection portion 16 while fine motions are given to the metal nozzle 21. When the anticorrosive material 20 is supplied with the fine motions given to the metal nozzle 21, it is a matter of course that air is hardly caught particularly in any position of the non-crimping part 18.

<Use Example of Terminal 1 with Electric Wire>

In FIG. 11, terminals 1 with electric wires are used as constituent components of a connector 51 to be disposed at a terminal end of a wire harness. The connector 51 is configured to include an insulating connector housing 52 in addition to a pair of terminals 1 with electric wires.

In FIG. 11 and FIGS. 12A and 12B, the connector housing 52 is a resin molded article, which is formed into a rectangular box-like shape. A pair of terminal reception chambers 53 are formed inside the connector housing 52. The terminal reception chambers 53 are formed to penetrate the connector housing 52 from its front face to its rear face. Lances 54 are formed in the terminal reception chambers 53 so that the crimping terminals 3 (locked portions 12) of the terminals 1 with electric wires can be caught and locked to the lances 54. In addition, stopper portions 55 and tab insertion ports 56 are formed in the terminal reception chambers 53. The crimping terminals 3 abut against the stopper portions 55. Tabs of not-shown mating terminal fittings are inserted into the tab insertion ports 56.

Each terminal reception chamber 53 is formed to be opened with a width W2 and a height H2 in a rear face of the connector housing 52. The width W2 is larger than the maximum width W1 of the anticorrosion portion 4 (W2>W1), and the height H2 is also larger than the maximum height H1 of the anticorrosion portion 4 (H2>H1). That is, even when the terminal 1 with an electric wire includes the anticorrosion portion 4, the crimping terminal 3 can be received in the terminal reception chamber 53 without any problem.

A guide rib 57 and locking arms 58 for a not-shown mating connector are formed on the outside of the connector housing 52.

<Summary of Terminal 1 with Electric Wire, and Effects of Manufacturing Method>

As has been described above with reference to FIGS. 1 to 12B, a terminal 1 with an electric wire is configured to include an aluminum electric wire 2 and a crimping terminal 3. The aluminum electric wire 2 is configured to include a conductor 5 made of aluminum or an aluminum alloy, and an insulating resin coating 6 covering the conductor 5. In the aluminum electric wire 2, the resin coating 6 is removed to form a conductor exposed portion 7 (electric wire processing step S1). On the other hand, the crimping terminal 3 includes a crimping portion 9 as a crimping part. A pair of conductor crimping pieces 14 and a pair of coating crimping pieces 15 are formed in the crimping portion 9. In the terminal 1 with an electric wire, the crimping portion 9 is crimped to the conductor exposed portion 7 so as to form a wire-terminal connection portion 16 (a wire-terminal connecting step S2). Then, an anticorrosion portion 4 is formed to cover the wire-terminal connection portion 16. The anticorrosion portion 4 is formed in such a manner that a voltage is applied between the crimping terminal 3 and a metal nozzle 21 and an anticorrosive material 20 that has been charged is supplied from the metal nozzle 21 so as to be attracted to the wire-terminal connection portion 16 (anticorrosive material supplying step S3). In addition, the anticorrosion portion 4 is formed in such a manner that the anticorrosive material 20 supplied to the wire-terminal connection portion 16 is UV-cured by irradiation with ultraviolet rays (anticorrosive material curing step S4).

According to the terminal 1 with an electric wire, the anticorrosive material 20 is attracted to the wire-terminal connection portion 16 due to an electrostatic force when the anticorrosion portion 4 is formed. In addition, an attractive force caused by the electrostatic force acts on the anticorrosive material 20 supplied to the wire-terminal connection portion 16, so that the anticorrosive material 20 can stay on the wire-terminal connection portion 16.

In addition, according to the terminal 1 with an electric wire, when the anticorrosion portion 4 is formed, the anticorrosive material 20 that has been charged is attracted by the electrostatic force so that the anticorrosive material 20 can turn around the opposite side to a position from which the anticorrosive material 20 is supplied. That is, the anticorrosive material 20 can be supplied to the whole circumference of the wire-terminal connection portion 16. The attractive force caused by the electrostatic force acts on the anticorrosive material 20 supplied to the whole circumference of the wire-terminal connection portion 16, so that the anticorrosive material 20 can stay at that place without dripping.

In addition, according to the terminal 1 with an electric wire, when the anticorrosion portion 4 is formed, the anticorrosive material 20 made of ultraviolet-curing resin is used. The attractive force caused by the electrostatic force acts on the anticorrosive material 20 so that the anticorrosive material 20 can stay on the wire-terminal connection portion 16. When the anticorrosive material 20 staying on the wire-terminal connection portion 16 is irradiated with ultraviolet rays, for example, by the UV light 23 or the like, the anticorrosive material 20 suffers energy due to the irradiation with the ultraviolet rays so that the anticorrosive material 20 can be cured while keeping the above-described staying state.

In addition, according to the terminal 1 with an electric wire, when the anticorrosion portion 4 is formed, the wire-terminal connection portion 16 can be formed including the conductor crimping part 17, the non-crimping part 18 around the conductor crimping part 17, and the coating crimping part 19. That is, the anticorrosion portion 4 can be formed in a comparatively wide range.

On the other hand, according to the method for manufacturing the terminal 1 with an electric wire, the anticorrosive material 20 can be supplied to the wire-terminal connection portion 16 while the metal nozzle 21 is moved in the X-, Y- and Z-directions. To say other words, the anticorrosive material 20 can be supplied to the wire-terminal connection portion 16 while fine motions are given to the metal nozzle 21. When the anticorrosive material 20 is supplied while fine motions are given to the metal nozzle 21, the wire-terminal connection portion 16 can be covered with the anticorrosive material 20 in a state where air is hardly caught.

Therefore, according to the method for manufacturing the terminal 1 with an electric wire, there is an effect that uneven application of the anticorrosive material 20 can be prevented. In addition, there is an effect that air can be prevented from being caught, and the caught air can be prevented from bursting when the anticorrosive material 20 is cured.

Figure 13:
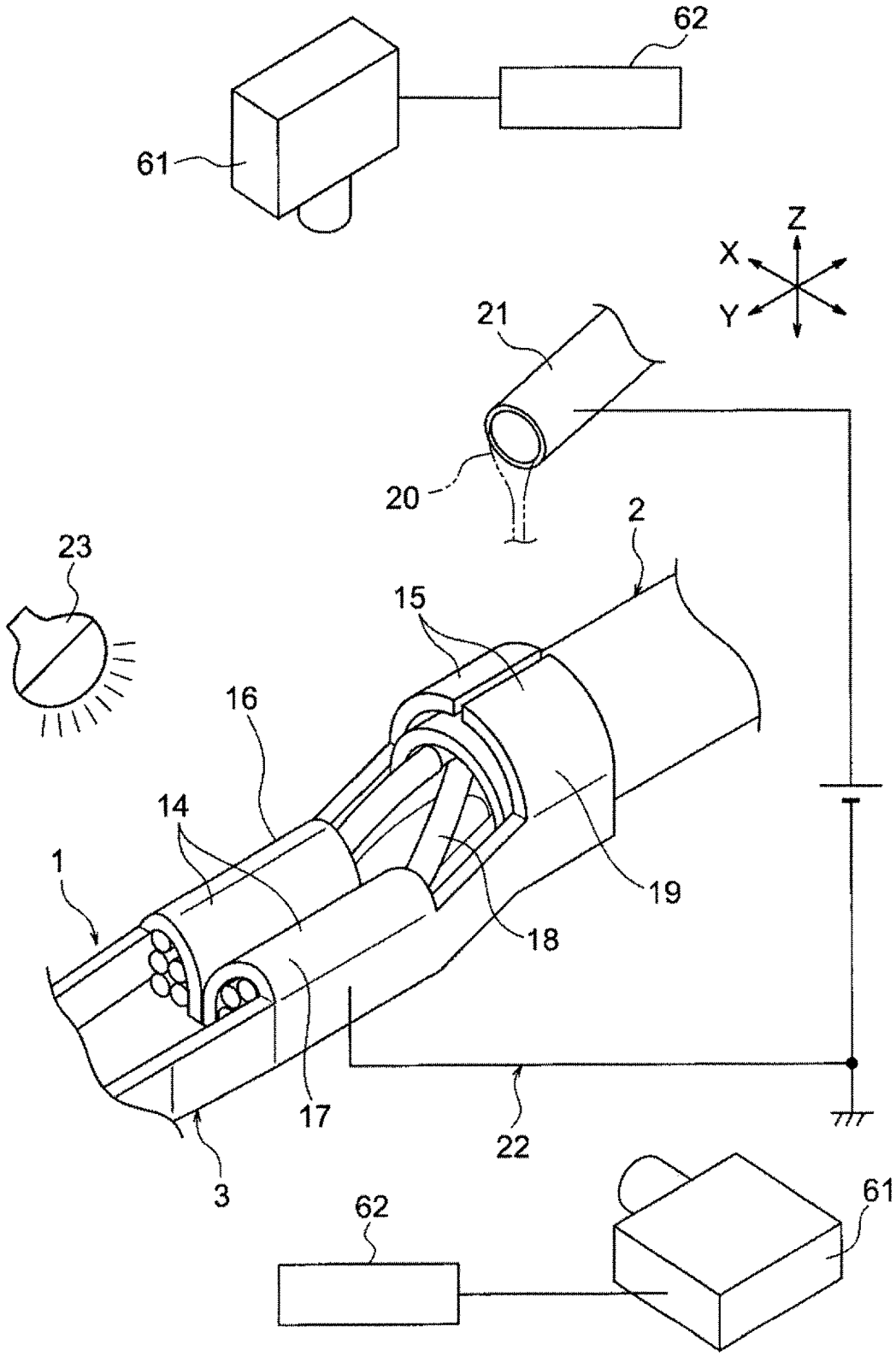
FIG. 13 is a perspective view as to a modification, for explaining a method for manufacturing a terminal with an electric wire.
Figure 14A:
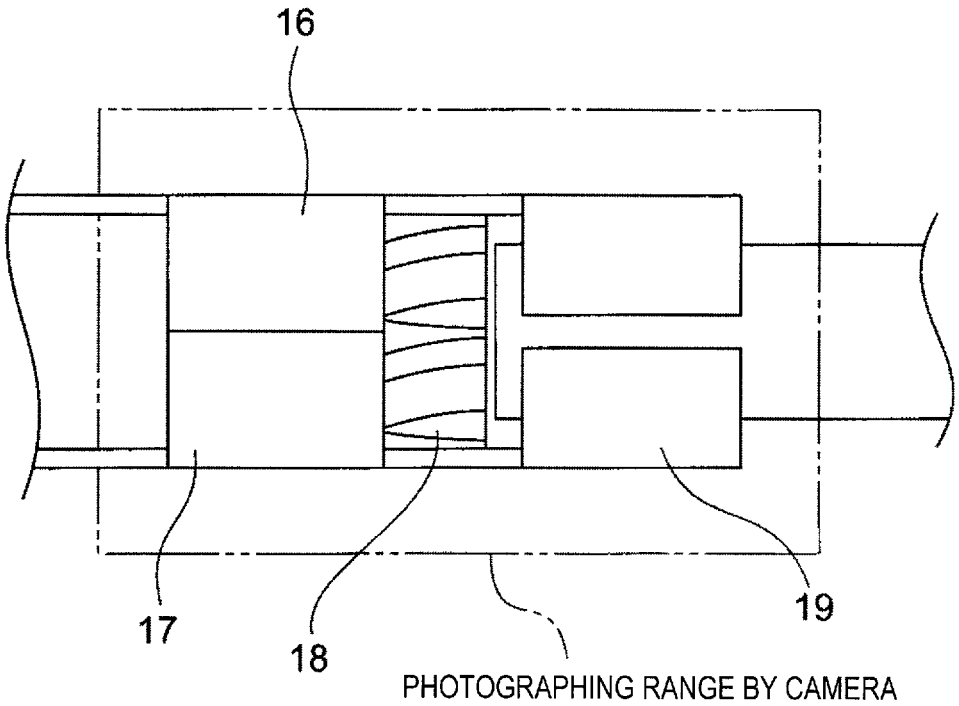
Figure 14B:
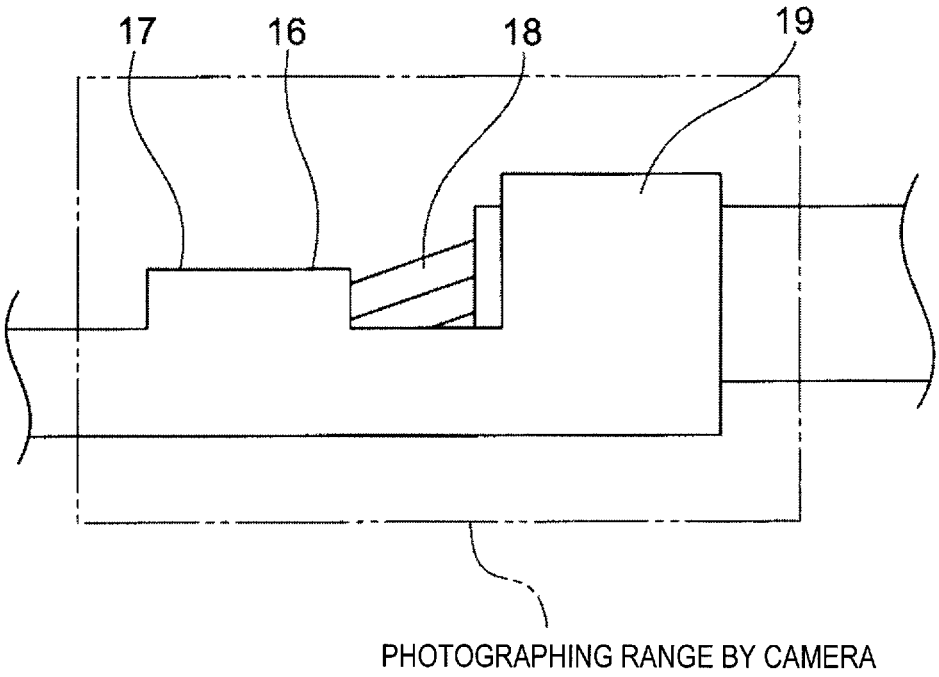
Figure 15A:
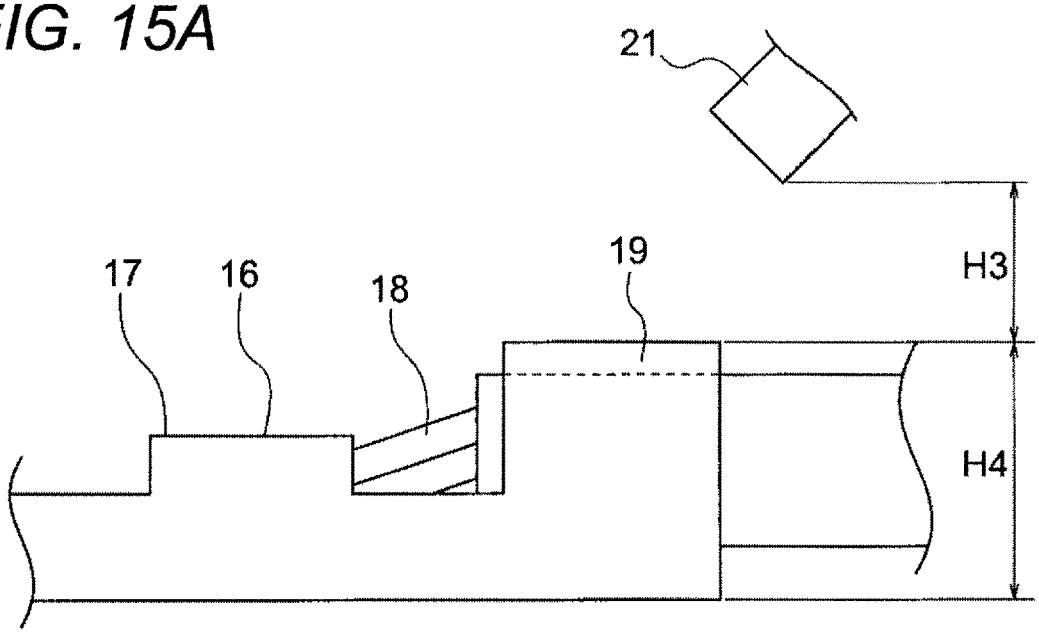
Figure 15B:
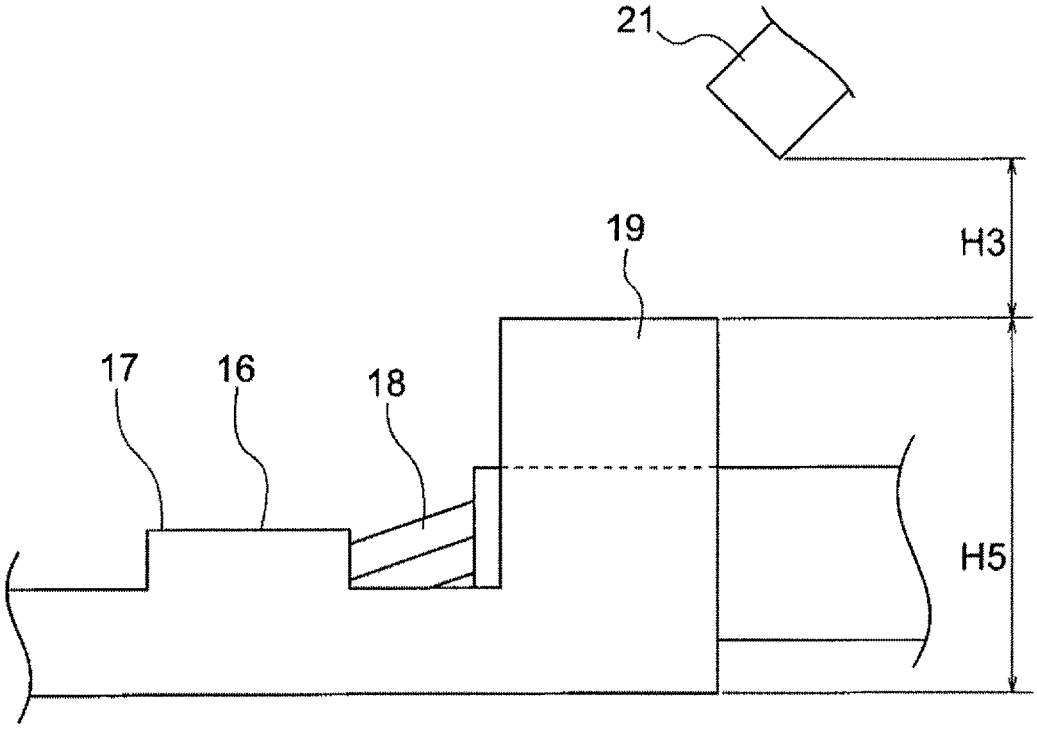
Figure 16A:
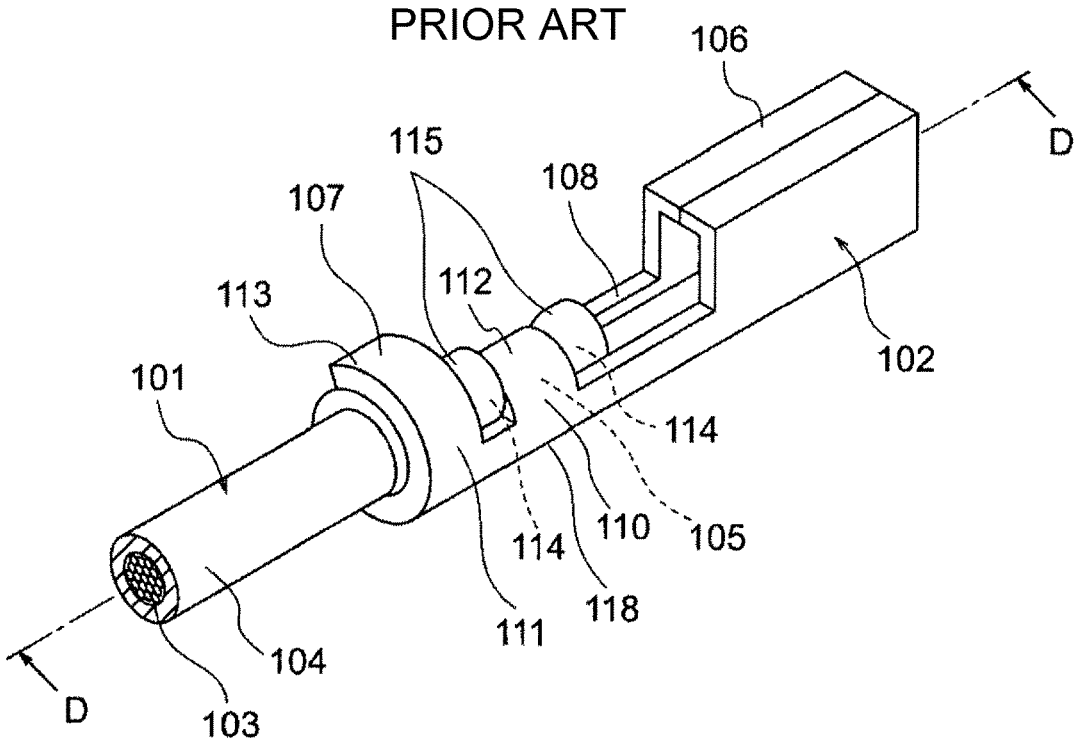
Figure 16B:
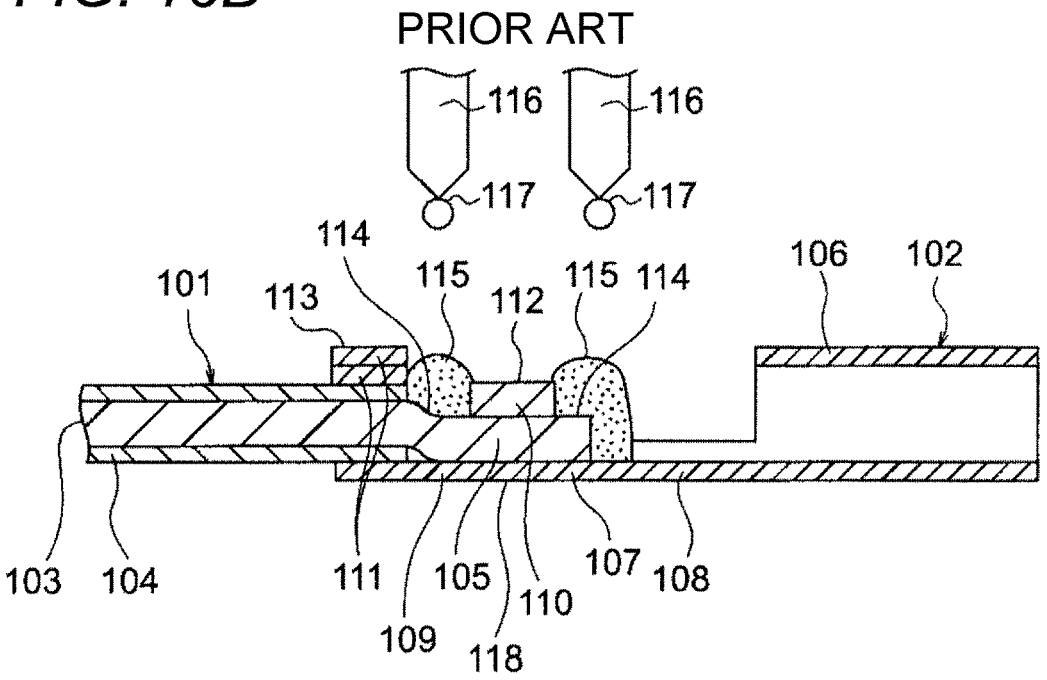

Modification as to Manufacturing Method According to Embodiment of the Invention A modification as to the manufacturing method according to an embodiment of the invention will be described with reference to FIGS. 13 to 15B. FIG. 13 is a perspective view as to a modification, for explaining a method for manufacturing a terminal with an electric wire. FIGS. 14A and 14B are views showing photographing ranges of cameras in FIG. 13, in which FIG. 14A is a view of the photographing range of an upper surface, and FIG. 14B is a view of the photographing range of a side surface. Further, FIGS. 15A and 15B are views showing an initial position of a metal nozzle in FIG. 13, in which FIG. 15A is a view in which height of a coating crimping part is low, and FIG. 15B is a view in which the height is high.

The modification is a manufacturing method including a nozzle initial position determining step (not shown). The nozzle initial position determining step is a step carried out between the wire-terminal connecting step S2 and the anticorrosive material supplying step S3 in FIG. 7. The nozzle initial position determining step is carried out to determine an initial position of the metal nozzle 21. In the nozzle initial position determining step, a nozzle initial position determining apparatus may be used as a constituent member required here. The nozzle initial position determining apparatus is configured to include two cameras 61, and a nozzle initial position determining portion 62.

In the nozzle initial position determining apparatus, images of the wire-terminal connection portion 16 are captured from its upper face and its side face by the two cameras 16 (not images of the whole of the wire-terminal connection portion 16 but images of only the coating crimping part 19 may be captured). Photographing ranges are, for example, illustrated by imaginary lines in FIGS. 14A and 14B. The images captured by the two cameras 61 are used for determining the initial position of the metal nozzle 21 in the nozzle initial position determining portion 62. When the initial position is determined, the metal nozzle 21 is disposed in the determined position. Specifically, as shown in FIG. 15A, the metal nozzle 21 is disposed at a constant height H3 on the rear side of the coating crimping part 19. Incidentally, it is assumed that the constant height H3 is fixed even when height of the coating crimping part 19 is changed from a low height H4 to a high height (see height H5) in FIG. 15B.

According to the nozzle initial position determining step, supplying the anticorrosive material 20 to the coating crimping part 19 can be always started at the same position. Thus, there is an effect that the anticorrosion portion 4 can be formed stably.

Incidentally, it is assumed that the metal nozzle 21 is inclined because the nozzle initial position determining apparatus is used in the nozzle initial position determining step. This is to avoid interference with the cameras 61. Even when the metal nozzle 21 is inclined, there arises no problem because the anticorrosive material 20 that has been charged is attracted due to an electrostatic force.

What is claimed is:

1. A method for manufacturing a terminal with an electric wire operatively associated with a supplying apparatus including a dispenser having a metal nozzle, the method comprising:

forming a conductor exposed portion by removing a resin coating of an electric wire;

forming a wire-terminal connection portion by connecting a terminal fitting to a position of the conductor exposed portion; and supplying a sealing material, delivered by the metal nozzle to the wire-terminal connection portion, wherein during supply of the sealing material, moving the metal nozzle occurs in X-, Y- and Z-directions over the wire-terminal connection portion or changing a relative position between the wire-terminal connection portion and the metal nozzle occurs in the X-, Y- and Z-directions, and the supplying the sealing material in a state electrically charged by applying a voltage between the metal nozzle and the terminal fitting such that the sealing material covers whole circumference of the wire-terminal connection portion around an axis of the terminal, including an opposite side of a supply position to which the sealing material is supplied by the metal nozzle.

2. The method for manufacturing a terminal with an electric wire according to claim 1, wherein forming the wire-terminal connection portion in a range comprising:

providing a conductor crimping part in which crimping the conductor exposed portion occurs by a conductor crimping piece of the terminal fitting;

providing a non-crimping part around the conductor crimping part; and providing a coating crimping part in which crimping the resin coating in a vicinity of the conductor exposed portion occurs by a coating crimping piece of the terminal fitting, and wherein the sealing material is supplied to cover the wire-terminal connection portion formed in the range, and during supply of the sealing material, at least in a position of the non-crimping part, the metal nozzle is moved in the X-, Y- and Z-directions or the relative position between the wire-terminal connection portion and the metal nozzle is changed in the X-, Y- and Z-directions.

3. The method for manufacturing a terminal with an electric wire according to claim 1, further comprising:

determining an initial position of the metal nozzle prior to supply of the sealing material based on an image of the wire-terminal connection portion which is captured from a predetermined position by a camera.

4. The method for manufacturing a terminal with an electric wire according to claim 1, wherein the sealing material is supplied in a stringy condition.

5. The method for manufacturing a terminal with an electric wire according to claim 4, wherein the sealing material is supplied in the stringy condition with tracking a three-dimensional shape of the wire-terminal connection portion with the metal nozzle.

* * * * *